US007670099B2

(12) United States Patent
Nakajima et al.

(10) Patent No.: US 7,670,099 B2
(45) Date of Patent: Mar. 2, 2010

(54) WORKING ARM FOR CONSTRUCTION MACHINE AND METHOD OF PRODUCING THE SAME

(75) Inventors: Toru Nakajima, Tsuchiura (JP); Takeshi Takahashi, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 973 days.

(21) Appl. No.: 10/550,729

(22) PCT Filed: Jun. 22, 2004

(86) PCT No.: PCT/JP2004/009079

§ 371 (c)(1),
(2), (4) Date: Sep. 26, 2005

(87) PCT Pub. No.: WO2005/001211

PCT Pub. Date: Jan. 6, 2005

(65) Prior Publication Data

US 2006/0201274 A1 Sep. 14, 2006

(30) Foreign Application Priority Data

Jun. 30, 2003 (JP) ..... 2003-187701

(51) Int. Cl.
*E02F 3/38* (2006.01)

(52) U.S. Cl. ..... 414/722; 29/897.2; 29/897.35; 228/155

(58) Field of Classification Search ..... 414/722, 414/694; 228/155, 164; 29/897.2, 897.35, 29/428

See application file for complete search history.

(56) References Cited

U.S. PATENT DOCUMENTS 2,085,829 A * 7/1937 Rogers ..... 29/897.35
5,125,787 A * 6/1992 Ball et al. ..... 414/722

FOREIGN PATENT DOCUMENTS

| | | |
|---|---|---|
| JP | 11-21939 | 1/1999 |
| JP | 11-158908 | 6/1999 |
| JP | 2001-20311 | 1/2001 |
| JP | 2004-124357 | 4/2004 |

* cited by examiner

*Primary Examiner*—Donald Underwood
(74) *Attorney, Agent, or Firm*—Mattingly & Malur, P.C.

(57) ABSTRACT

A wide plate-like material (27), having thin and thick wall portions in a transverse direction, is prepared by alternately joining one of flat thin plates (28, 29) and one of thick corner plates (30) or thick plates (31). The wide plate-like material (27) is bent at and along right and left thick corner plates (30) and formed into a U-shaped structure (32) which is U-shape in cross section. Separately from the U-shaped structure (32), a plate-like member (33) is prepared by butt welding thick plates (35) to right and left sides of a thin plate (34). The plate-like member (33) is welded to a lower side of the U-shaped structure (32) by laser welding or the like to form a square tubular structure, which is in a square shape in cross section and serves as a major part of an operating arm.

6 Claims, 24 Drawing Sheets

WORKING ARM FOR CONSTRUCTION MACHINE AND METHOD OF PRODUCING THE SAME

TECHNICAL FIELD

This invention relates to an operating arm for a construction machine, and more particularly to an operating arm suitable for use on a construction machine, for example, such as an excavating machine like a hydraulic excavator, and a method of fabrication of such operating arm.

BACKGROUND ART

Generally, a hydraulic excavator, typical of construction machines, is largely constituted by an automotive base structure, a revolving structure which is rotatably mounted on the base structure, and a working mechanism as a front part liftably mounted on a front portion of the revolving structure, including a boom, an arm and a front attachment (e.g., a bucket).

An operating arm, such as the boom and arm, of the working mechanism (front part) is formed in a square tubular structure of a square shape in cross-section, for example, by joining together four steel plates, i.e., an upper plate, a lower plate, a right side plate and a left side plate (e.g., as disclosed in Japanese Patent Laid-Open No. H11-21939).

For the purpose of enhancing rigidity and at the same time for reducing weight, operating arms on conventional construction machines of this sort are usually fabricated by the use of an upper plate which is provided with a thin wall portion between right and left thick wall portions. Likewise, a lower plate is provided with a thin wall portion between right and left thick wall portions. A square tubular structure is formed by joining right and left side plates with the thick wall portions of the upper and lower plates by butt-welding. In this way, attempts have been made to guarantee high rigidity to a square tubular structure despite reductions in weight.

Further, according to another prior art, a square tubular structure of an operating arm for a construction machine is formed by a combination of four corner members which are located at four corner portions (corners), and four flat plates joined between the corner members (e.g., as disclosed in Japanese Patent Laid-Open No. 2001-20311).

In this case, in order to prevent concentration of stress in corner portions of the operating arm formed as the square tubular structure, each one of the four corner members located at the corners is formed in a curved (or rounded) L-shape in cross-section beforehand. These corner members are joined with the flat plates afterwards by welding to form the square tubular structure which is square in cross-section.

In this regard, in the case of the first-mentioned prior art, thick wall portions are provided in right and left side portions of upper and lower plates, and right and left side plates are joined with the thick wall portions of the upper and lower plates by butt-welding as mentioned above. Thus, in this case, since the upper and lower plates are not required to have a large thickness in their entire bodies, there is an advantage that the weight of the operating arm can be reduced while guaranteeing a certain degree of rigidity.

However, in the case of the prior art just mentioned, at the time of joining right and left side plates with right and left thick wall portions of the upper and lower plates by butt welding, the right and left side plates have to be placed in a precisely aligned position between the upper and lower plates by the use of an aligning jig of a complicate shape. Further, in this case, there is a problem that the arm has to be assembled by a 3D welding operation which requires enormous labor and time.

Following problems arise especially in case high energy density welding such as laser welding is used for 3D welding. Namely, when joined by 3D welding, gaps are likely to occur between joining surfaces of the upper and lower plates and right and left side plates. If a gap of 0.5 mm or greater exists between joining surfaces, for example, the vicinity of the joining surfaces may come out of a laser irradiation range, failing to form a joint of sufficient strength.

In addition, each one of corner portions in the above-mentioned square tubular structure is constituted by a thick wall portion of the upper or lower plate and a joining portion (a welding portion) of the right or left side plate. Therefore, the welding portion in the respective corner portions are susceptible to residual stress or concentration of stress, and are difficult to ensure sufficient rigidity as an operating arm of a construction machine.

On the other hand, in the case of the second prior art mentioned above, corner portions of the operating arm formed as a square tubular structure are formed by corner members of rounded L-shape in cross-section, which has an advantage of suppressing influences of residual stress and concentration of stress.

However, in the case of this second prior art, the four corner members as well as the four flat plates which interconnect the four corner members are formed of steel plates which are substantially uniform in thickness. Therefore, in this case, it is difficult to satisfy two contradictory demands, i.e., weight reduction and high rigidity of an operating arm. That is to say, there is a problem that the weight of the operating arm as a whole is increased if thick steel plates are used to guarantee high rigidity.

If an operating arm is fabricated by the use of thinner steel plates for the sake of weight reduction, corner members and flat plates have to be butted against each other in a precisely aligned state at the time of joining them together, for example, by 3D welding which requires a great deal of labor and time for alignment of joining parts.

DISCLOSURE OF THE INVENTION

In view of the above-discussed problems with the prior art, it is an object of the present invention to provide an operating arm for a construction machine, the arm being fabricated in a square tubular structure by the use of a plural number of joined plates of different thicknesses to achieve two contradictory aims, weight reduction and retention of high rigidity, and to provide a method of fabricating an operating arm of the sort just mentioned.

It is another object of the present invention to provide an operating arm for a construction machine, assembled with sufficiently strong joint strength and efficiently by means of 2D welding which requires far easier parts alignment as compared with 3D welding, and a method of fabrication of the operating arm structure.

In accordance with the present invention, in order to achieve the above-stated objectives, there is provided an operating arm for a construction machine for use as a front part of a construction machine, the operating arm being constituted by a plural number of joined plates and in the shape of a square tubular structure of a square shape in cross section.

The operating arm according to the present invention is characterized in that: the plural number of joined plates include flat thin plates to be formed into flat sections of the square tubular structure and thick corner plates being greater in thickness in a flat shape than the flat thin plates joined side to side with the flat thin plates beforehand and bent into a convexly curved shape afterwards to form corner portions of the square tubular structure.

With the arrangements just described, by using steel plates of different thicknesses as the flat thin plates and the thick corner plates, there can be obtained a plate material of versatile utility and can be adopted as a starting material in the fabrication of an operating arm. The thick corner plates are in a flat shape before being bent into a convexly curved shape in a bending stage. When in a flat shape, the thick corner plates can be brought into a butt welding position simply by abutting its joining side against a flat thin plate. For example, the flat thin plates and the thick corner plates can be joined together easily by 2D welding. Namely, by abortion of 3D welding as in the above-mentioned prior art, joining parts can be aligned and set in relative positions in an extremely facilitated manner. Besides, it becomes possible to increase the thickness of thick corner plates which form corner portions of the square tubular structure while reducing the thickness of flat thin plates which form flat side sections of the square tubular structure, for providing an operating arm which is satisfactory in rigidity but reduced in weight as a whole.

Namely, as a result of an analysis of structural strength required of operating arms of construction machines, the inventors of the present invention have found that it is necessary for the square tubular structure of an arm to have an ample wall thickness in corner portions of the square tubular structure for the sake of rigidity, but a share of load in flat side sections located between the corner portions is far smaller as compared with the corner portions.

Therefore, the weight of the operating arm as a whole can be minimized by reducing the thickness of flat thin plates which constitute flat side sections of the square tubular structure. On the other hand, the thick corner plates which constitute corner portions of the square tubular structure are increased in thickness to guarantee enhanced rigidity of the operating arm as a whole. Accordingly, the square tubular structure which is constituted by the combination of flat thin plates and thick corner plates has sufficient strength for supporting reaction forces which are imposed on the operating arm during an excavating operation or the like, and provided sufficient rigidity as the operating arm.

Further, according to a preferred form of the present invention, the thick corner plates and the flat thin plates are joined together by side to side butt welding to form a wide plate-like material having alternately thick and thin wall portions in a transverse direction, the wide plate-like material being bent along the thick corner plates to form a U-shaped structure in cross section for use as a part of the square tubular structure.

In this case, the wide plate-like material which is prepared by butt welding flat thin plates and thick corner plates is formed into U-shape in cross section by bending same at the positions of the thick corner plates, for example, on a press to fabricate a U-shaped structure to be used as a major part of a square tubular structure which is in square shape in cross section.

Further, according to a preferred form of the present invention, the flat thin plates and the thick corner plates are joined by side to side butt welding such that surfaces of the flat thin plates are positioned flush with the thick corner plates on one side in the direction of thickness but indented from the thick corner plates on the other side in the direction of thickness.

In this case, the one side in the direction of thickness is prepared for the outer side of the square tubular structure, the square tubular structure has smoothly joined surfaces on the outer side, instead of the other side where surfaces of the flat thin plates are indented from the thick plates due to a difference in plate thickness.

According to another preferred form of the present invention, the flat thin plates and the thick corner plates are joined together by side to side butt welding such that surfaces of the flat thin plates are indented from the thick corner plates on one side in the direction of thickness but positioned flush with the thick corner plates on the other side in the direction of thickness.

In this case, exertion of tensile stress at welded joint portions between the flat thin plates and the thick corner plates can be suppressed to a low level at the time of bending the thick corner plates in such a direction as to expose raised and indented surfaces on the outer side of the square tubular structure, preventing development of cracks from welded joint portions. In addition, the raised and indented surfaces of the thick and thin plates on the outer side of the square tubular structure, so that one can utilize the raised and sunken surface for putting an emphasis on sturdiness in arm design for adding to a commercial value as an operating arm of a construction machine.

According to still another preferred form of the present invention, the flat thin plates and the thick corner plates are joined together by side to side butt welding such that surfaces of the flat thin plates are indented from the thick corner plates on both sides in the direction of thickness.

In this case, the raised and indented surfaces of the thick and thin plates can be exposed on the outer side of the square tubular structure, utilizing the design effects of the raised and indented surfaces for adding to a commercial value as an operating arm of a construction machine.

Further, according to the present invention, a boss mounting thick plate to be formed a boss mount member of the front part is joined with one longitudinal end of the flat thin plates and thick corner plates of the square tubular structure prior to a bending operation, the boss mounting thick plate being bent into U-shape simultaneously with the thick corner plates.

In this case, a boss mounting thick plate to be formed a boss mount member of the front part is joined with one longitudinal end of flat thin plates and thick corner plates beforehand, and bent into U-shape simultaneously with the thick corner plates, reducing steps of bending operations to make the fabrication process more efficient.

Further, according to the present invention, the boss mounting thick plate is substantially of the same thickness as the thick corner plates. Therefore, the boss mounting thick plate and the thick corner plates can be bent simultaneously under uniform distribution of stress and loads.

On the other hand, according to the present invention, there is also provided a method of fabricating an operating arm for a construction machine for use as a front part of a construction machine, the operating arm being constituted by a plural number of joined plates and in the shape of a square tubular structure of a square shape in cross section, characterized in that the method comprises: a first welding stage for preparing a wide plate-like material having alternately thick and thin wall portions in a transverse direction by butt welding side to side the plural number of joined plates in diffirent thicknesses to form the squqre tubular structure; a bending stage for bending the wide plate-like material along thick plate portions to form corner portions of the square tubular structure, and to form a U-shaped structure having a U-shape in cross section through plastic deformation; a second welding stage for welding a separate plate-like member to the U-shaped structure to close an opening of the latter to form the square tubular structure of a square shape in cross section.

By adoption of the method just described, a wide plate-like material having thin and thick wall portions alternately in a transverse direction is prepared in a first welding stage by joining a plural number of thin and thick joined plates by side to side butt welding, more particularly, by 2D butt welding. In a succeeding bending stage, the wide plate-like material is bent along thick wall portions to form a U-shaped structure which is U-shape in cross section. In a second welding stage, a separately prepared plate-like material is joined with the U-shaped structure to close an opening in the U-shaped structure. As a result, a square tubular structure having a square shape in cross section is fabricated from the U-shaped structure for use as an operating arm.

Further, according to the present invention, the first welding stage further comprises welding a boss mounting thick plate to be formed a boss mount member of the front part to one longitudinal end of the wide plate-like material, and the bending stage comprises bending the boss mounting thick plate into U-shape in cross section simultaneously when the wide plate-like material is bent to form the U-shaped structure.

In this case, a boss mounting thick plate to be formed a boss mount member of the front part is joined with one longitudinal end of the wide plate-like material prior to the bending stage, and bent into U-shape together with the wide plate-like material in the bending stage, permitting to reduce the steps of bending operation and to enhance the efficiency of fabrication process. Further, in a case where a boss mounting thick plate is joined with one longitudinal end of a wide plate-like material, it becomes possible to enhance further the strength of welded joints (between thin and thick plates) of the wide plate-like material prior to the bending stage, suppressing adverse effects of bending loads which might otherwise posed on flat thin plate portions of the wide plate-like material.

Further, according to the present invention, the thin and thick plates are joined by high energy density welding of deep penetration in the first welding stage. In this case, it becomes possible to enhance the strength of welded joints in the wide plate-like material which is composed of a plural number of thin and thick plates by adoption of high energy density welding of deep penetration, securing sufficient joint strength against loads which are imposed in the bending stage.

BEST MODE FOR CARRYING OUT THE INVENTION

Figure 1:
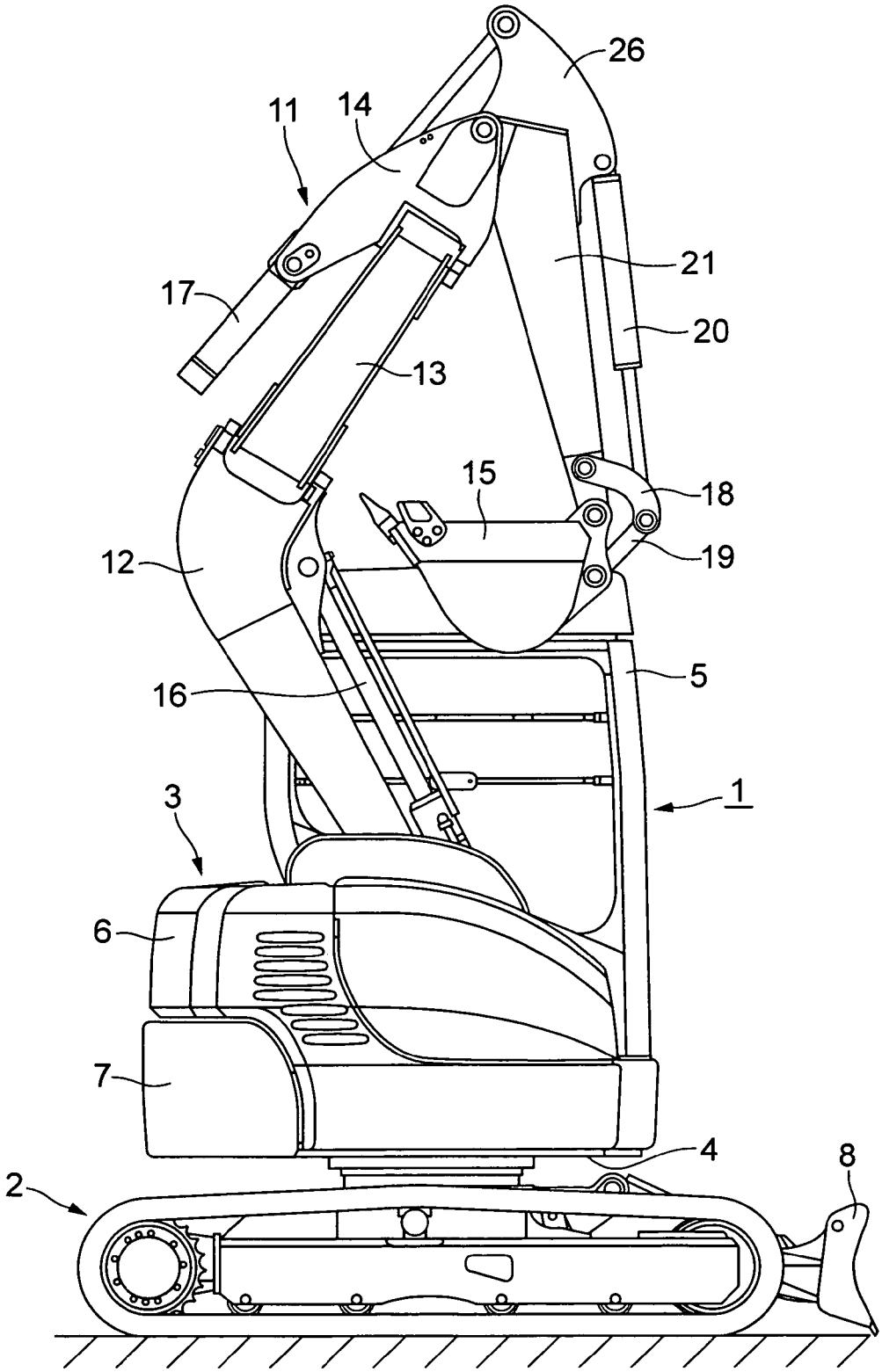
FIG. 1 is a front view of a hydraulic excavator adopting to a first embodiment of the present invention.

Hereafter, with reference to the accompanying drawings, the operating arm for a construction machine and a method of fabricating the operating arm, according to the present invention, is described more particularly by way of its preferred embodiments which are applied by way of example to a hydraulic excavator employing an offset type boom for its working mechanism.

Of the accompanying drawings, shown in FIGS. 1 through 12 is a first embodiment of the present invention. In these figures, indicated at 1 is a hydraulic excavator as a typical example of construction machines. The hydraulic excavator 1 is largely constituted by an automotive crawler type base structure 2, a revolving structure 3 which is rotatably mounted on the automotive base structure 2 and a working mechanism 11, which will be described hereinafter.

In the case of the particular embodiment shown, the revolving structure 3 is largely constituted by a revolving frame 4, a cab 5 which is provided on the revolving frame 4, an exterior cover 6, and a counterweight 7. The cab 5 is an operational housing which internally defines an operating room to be occupied by an operator at the control of the machine. Together with the counterweight 7, the exterior cover 6 defines a machine room for accommodating an engine and a hydraulic pump (both not shown).

Indicated at 8 is a soil sweeper blade which is provided on the front side of the automotive base structure 2. The soil sweeper blade 8 is liftable up and down relative to the base structurer 2, and used, for example, for leveling a ground surface or for removing soil.

Denoted at 11 is an offset boom type working mechanism as a front part which is liftably provided in a front side of the revolving structure 3. This working mechanism 11 is constituted by a lower boom 12 which is liftably mounted on the revolving frame 4, an upper boom 13 which is pivotally attached to the fore end of the lower boom 12 for swinging movements in rightward and leftward directions, an arm stay 14 which is pivotally attached to the fore end of the upper boom 13 for swinging movements in rightward and leftward directions, an arm 21 which is pivotally attached to the fore end of the arm stay 14 for upward and downward rotational movements, which will be described hereinafter, and a bucket 15 which is pivotally supported at the fore end of the arm 21 as a front attachment.

In this instance, the lower boom 12, upper boom 13 and arm 21 of the working mechanism 11 constitute an operating arm of the construction machine. In the case of the offset boom type working mechanism 11, a link rod (not shown) is pivotally connected between a fore end of the lower boom 12 and the arm stay 14 for swing movements in rightward and leftward directions.

The above-mentioned link rod form a parallel link mechanism together with the lower boom 12, upper boom 13 and arm stay 14 thereby to keep the arm 21 (the arm stay 14) constantly in parallel relation with the lower boom 12.

Further, a boom cylinder 16 is provided between the revolving frame 4 and the lower boom 12, and an arm cylinder 17 is provided between the arm stay 14 and the arm 21. A bucket cylinder for the front attachment is provided between the arm 21 and the bucket 15 and through links 18 and 19.

Furthermore, an offset cylinder (not shown) is provided between the lower boom 12 and upper boom 13. The offset cylinder is expanded or contracted, for example, at the time of a side ditch or side-gutter excavating operation to move the arm 21 to the right or to the left in parallel relation with the lower boom 12 through the above-mentioned parallel link.

Indicated at 21 is an arm employed as an operating arm of the working mechanism 11 for a construction machine. As shown in FIGS. 2 through 12, this arm 21 is constituted by a square tubular structure 22 extending in the longitudinal direction, a boss mount member 23 joined with a couple of boss portions 23A and 23B and located at one longitudinal end of the square tubular structure 22, a second boss mount member 24 joined with a single boss portion 24A and located at the other longitudinal end of the square tubular structure 22, and a cylinder bracket 26, which will be described hereinafter.

Figure 8:
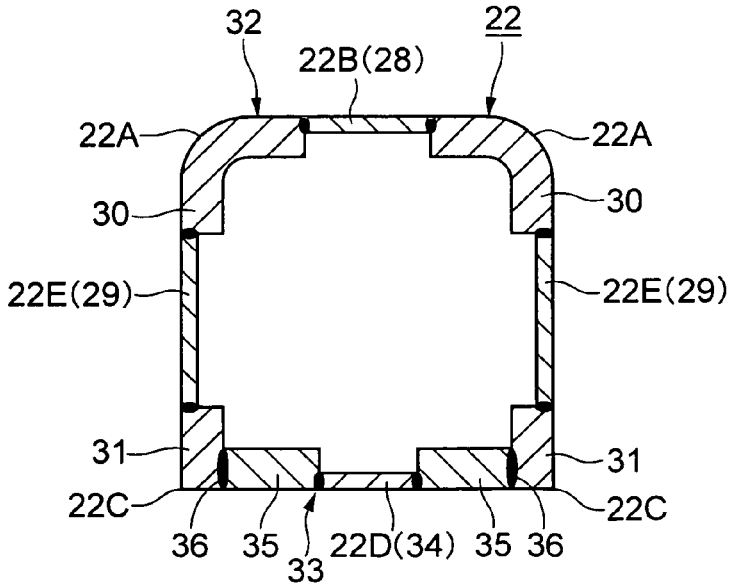
FIG. 8 is a sectional view of the plate-like member and the U-shaped structure which are joined together to form a square tubular structure.

In this instance, as shown in FIG. 8, the square tubular structure 22 which constitute a major part of the arm 21 is formed as a hollow tube which is substantially of a square shape in cross-section. Namely, the square tubular structure 22 is composed of a pair of upper corner portions 22A which are located at right and left upper corners of the square tubular structure, an upper flat section 22B which is located between the upper corner portions 22A, a pair of lower corner portions 22C which are located at the right and left lower corners of the square tubular structure, a lower flat section 22D which is located between the right and left lower corner portions 22C, and right and left flat sections 22E located between the upper and lower corner portions 22A and 22C.

The upper corner portions 22A of the square tubular structure 22 are each formed of a thick corner plate 30, while the upper flat section 22B is formed of flat thin plate 28, as described in greater detail hereinafter. Likewise, the lower corner portions 22C are each formed of a thick plate 31, while the lower flat section 22D is formed of a thin plate 34, as described in greater detail hereinafter. The right and left flat sections 22E are each formed of a flat thin plate 29 which will be described hereinafter.

At the boss mount member 23 at one end of the arm 21, a link 18 which is shown in FIG. 1 is pivotally connected to the boss portion 23A through a pin, and the bucket 15 is pivotally supported at the boss portion 23B through a pin. On the other hand, at the boss mount member 24 at the other end of the arm 21, the arm stay 14 which is shown in FIG. 1 is pivotally connected to the boss portion 24A through a pin.

Figure 2:
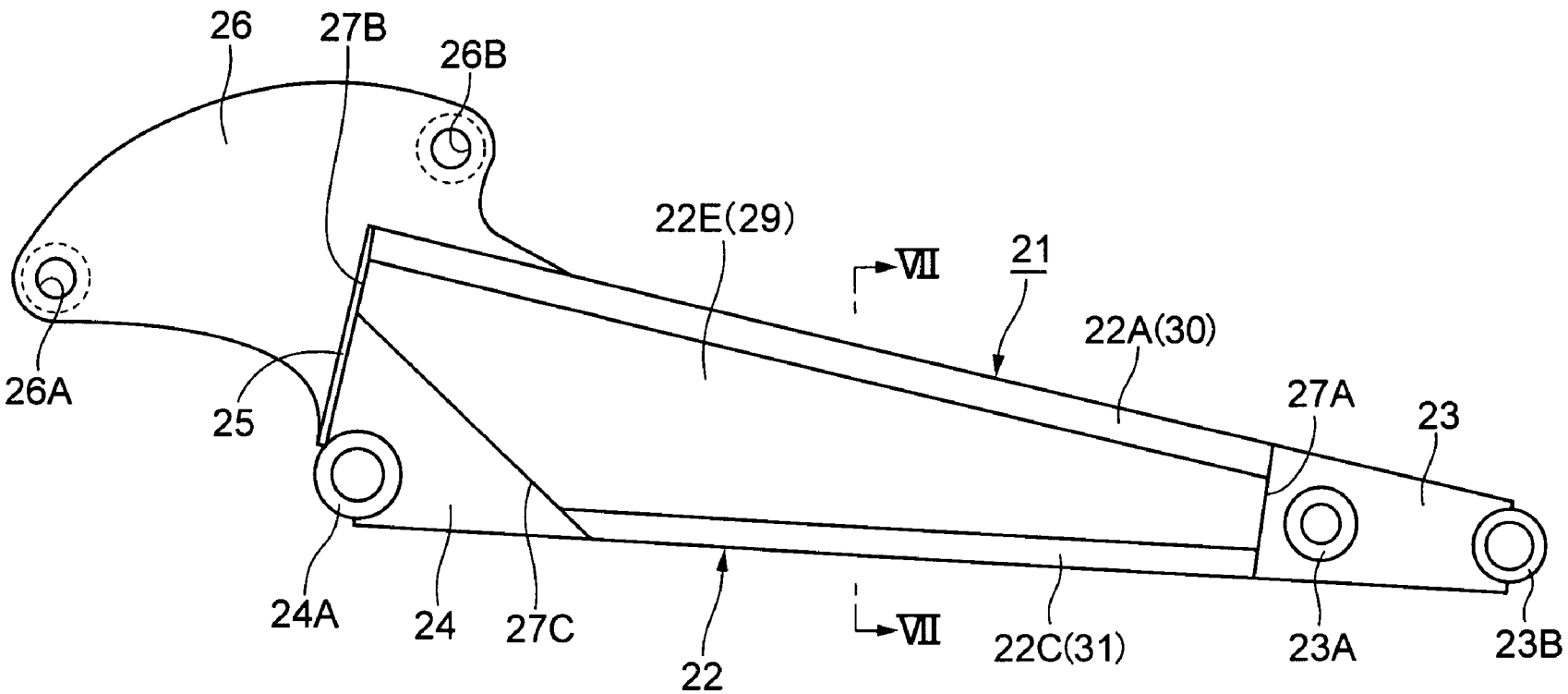
FIG. 2 is an enlarged front view of the arm of FIG. 1, showing the arm alone.

Indicated at 25 is a lid plate which closes the other end of the square tubular structure 22 together with the boss mount member 24, and at 26 is a cylinder bracket which is attached to the other end of the square tubular structure 22 through the lid plate 25. In this instance, as shown in FIGS. 1 and 2, the cylinder bracket 26 is formed as a bracket plate substantially in the shape of a diverging fan and bored with a couple of pin-receiving holes 26A and 26B.

A rod side end of the arm cylinder 17, shown in FIG. 1, is pivotally connected through a pin at the pin-receiving hole 26A of the cylinder bracket 26, and a bottom side end of the bucket cylinder 20 is pivotally connected through a pin at the pin-receiving hole 26B.

Figure 3:
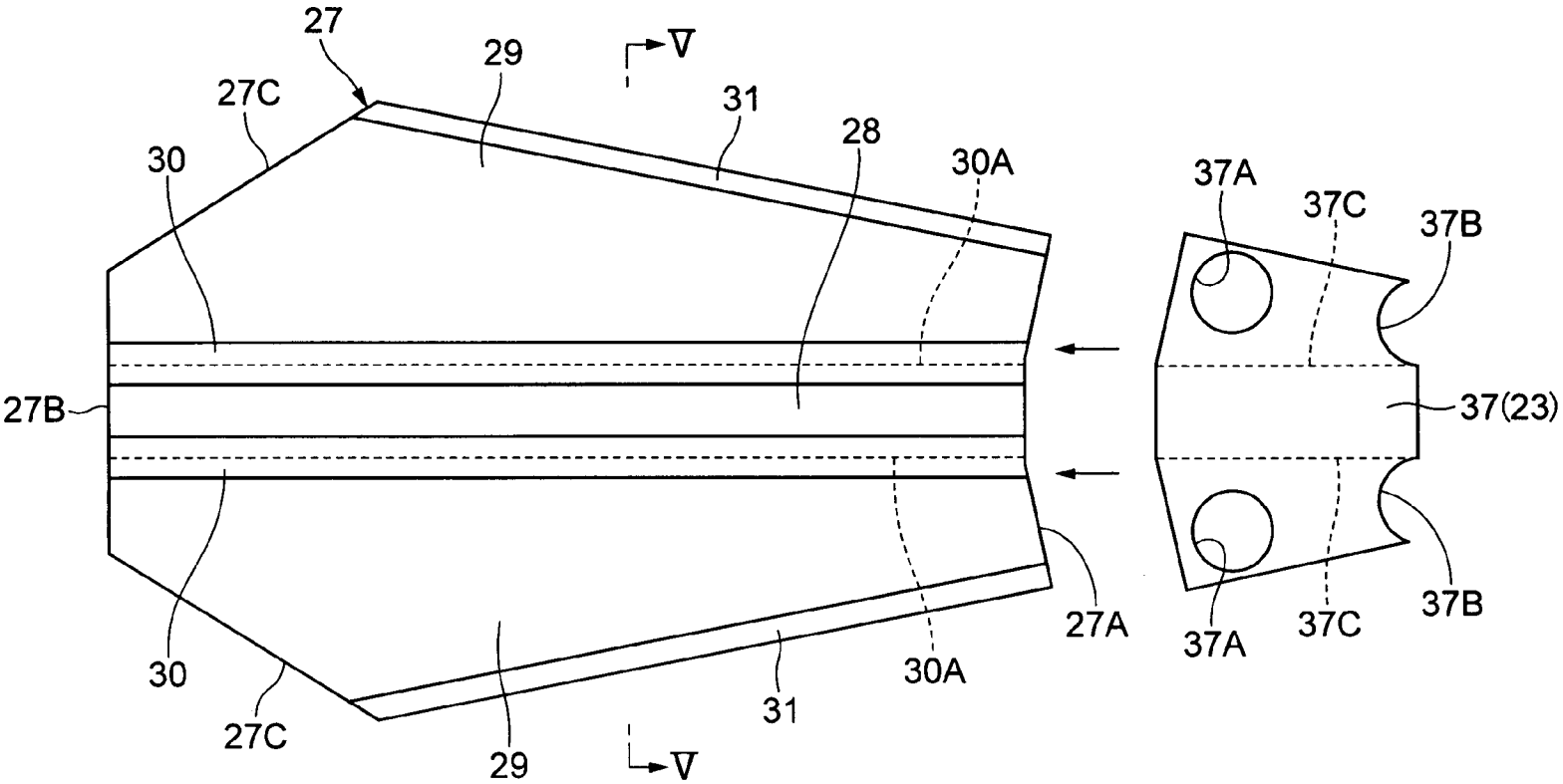
FIG. 3 is a plan view of a wide plate-like material to be used in the fabrication of an operating arm, and a boss mounting thick plate.
Figure 4:
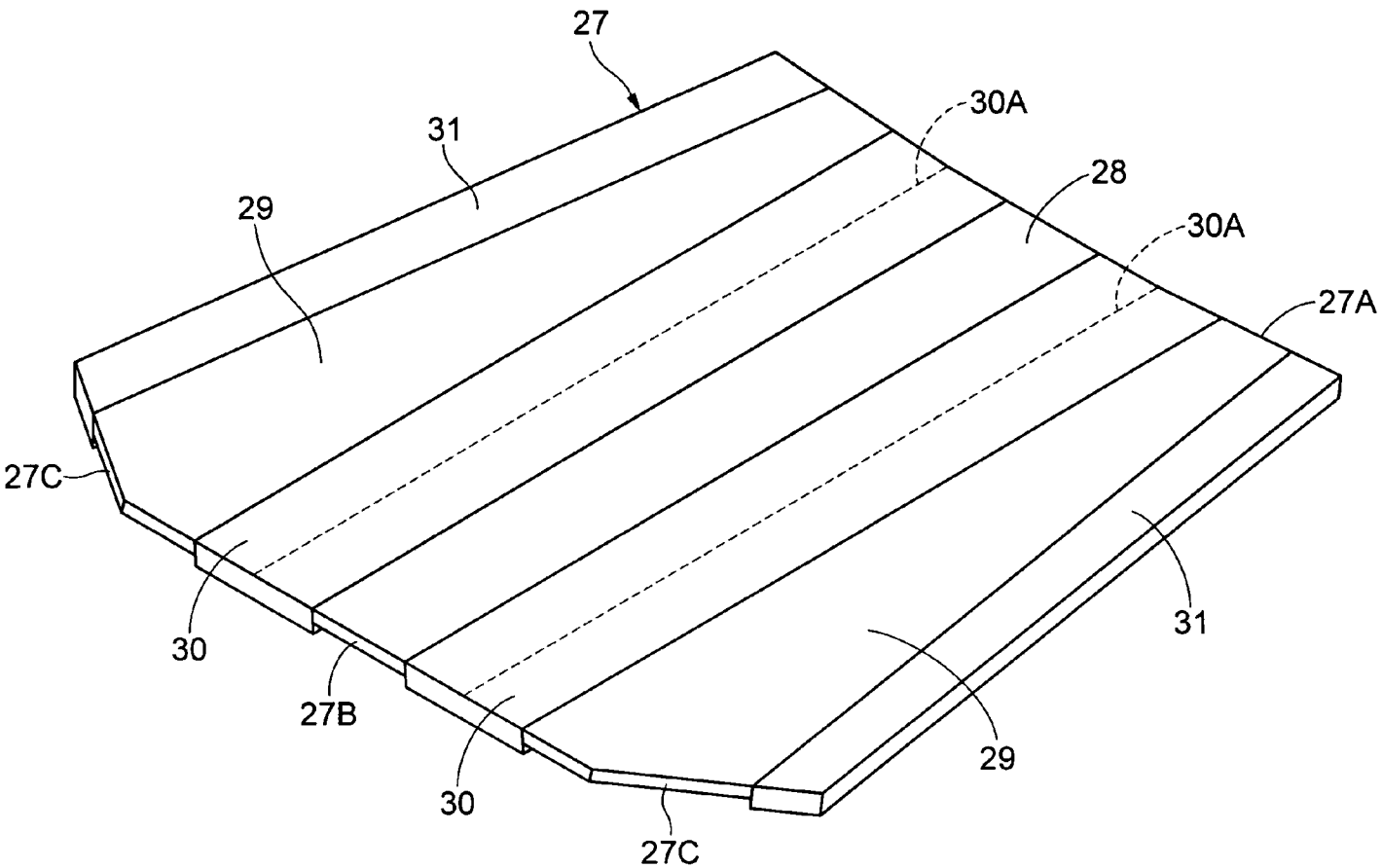
FIG. 4 is a perspective view of the wide plate-like material in FIG. 3, taken from the above slant direction.
Figure 5:
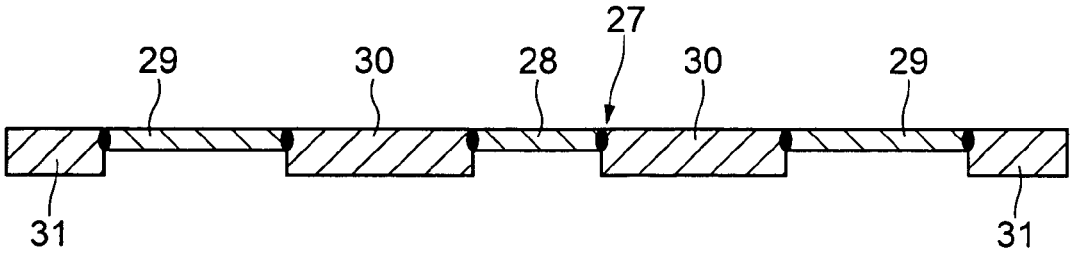
FIG. 5 is an enlarged sectional view of the wide plate-like material, taken in the direction of arrows V-V in FIG. 3.

Indicated at 27 is a wide plate-like material employed as a base or starting material in the fabrication of the square tubular structure 22. As shown in FIGS. 3 to 5, this wide plate-like material 27 is composed of a longitudinally extending flat thin plates 28, 29, thick corner plates 30 and thick plates 31, which are joined together side to side by butt welding. More particularly, for example, these plate materials are pre-joined by high energy density welding like laser welding capable of deep penetration.

In this instance, the flat thin plate 28 which is located centrally of the wide plate-like material 27 is formed by the use of an elongated longitudinally extending flat steel plate. Similar to the flat thin plate 28, the right and left thick corner plates 30 which are joined with the opposite sides (right and left directions) of the flat thin plate 28 are each formed by the use of an elongated longitudinally extending flat steel plate.

As shown in FIGS. 4 and 5, the flat thin plates 28 and 29 are joined with the thick corner plates 30 and the thick plate 31 by side to side butt welding in such a way as to be disposed substantially flush with each other on one side (upper surface) in the direction of thickness, and raised and indented surface with each other on the other side (lower surface) in the direction of thickness.

Figure 6:
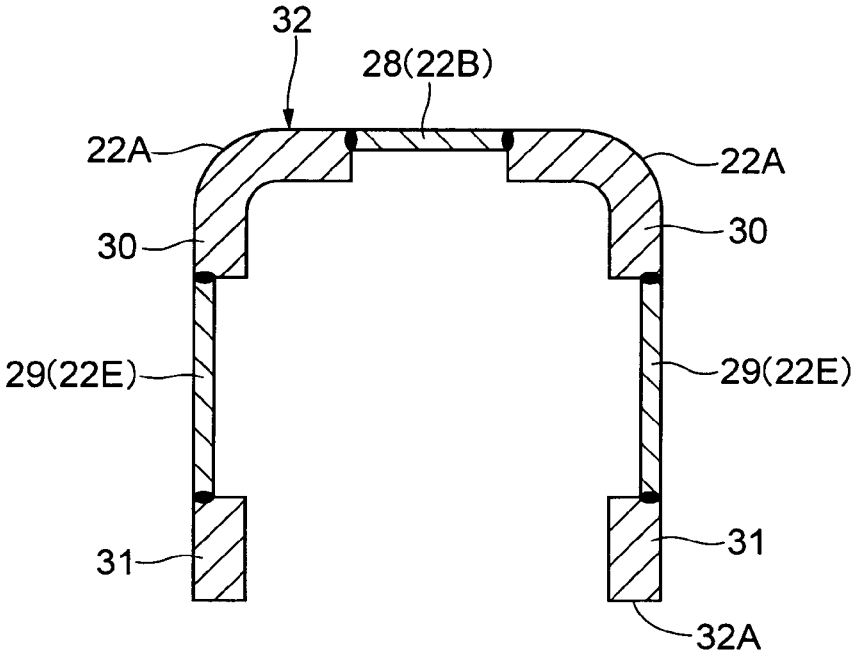
FIG. 6 is a sectional view of a U-shaped structure which is formed by bending the wide plate-like material of FIG. 5 into U-shape.

The thick corner plates 30 of the wide plate-like material 27 is greater in thickness than the flat thin plate 28, and are bent in a convexly curved shape along a center folding line 30A indicated by a broken line in FIGS. 3 and 4. By a bending operation, the thick corner plates 30 are bent into a curved (or rounded) L-shape in cross section as shown in FIG. 6 to form upper corner portions 22A of the square tubular structure 22 as shown in FIG. 8.

Further, as shown in FIGS. 3 and 4, the right and left flat thin plates 29 which are joined on the outer side of the right and left thick corner plates 30 are each constituted by a thin wall steel plate substantially of a trapezoidal shape extending longitudinally along the thick corner plate 30. The right and left thick plates 31 which are joined on the outer sides of the flat thin plate 29 are each constituted by a thick steel plate extending longitudinally along and on the outer side of the flat thin plate 29.

In the case of the particular example shown, the flat thin plates 28 and 29 are each formed of a steel plate which is, for example, 3 mm to 6 mm thick, preferably, 3.2 mm thick. On the other hand, the thick corner plates 30 and the thick plates 31 is formed of a steel plate of a double thickness (e.g., of 6 mm to 12 mm in thickness) as compared with the flat thin plates 28 and 29.

The wide plate-like material 27 which is composed of the thin plates 28 and 29 and the thick plates 30 and 31 is joined with the boss mount member 23 (of a boss mounting thick plate 37 which will be described hereinafter) at a joining end 27A at one longitudinal end as shown in FIG. 3, and joined with the lid plate 25 at a joining end 27B at the other longitudinal end as shown in FIG. 2.

Figure 12:
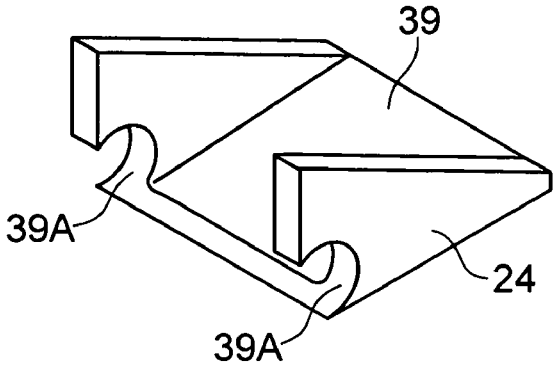
FIG. 12 is a perspective view of a boss mount member which is formed by bending the boss mounting thick plate of FIG. 11.

At the other longitudinal end, the wide plate-like material 27 is provided with obliquely cut portions 27C extending obliquely outward from opposite sides of the joining end 27B toward the outer side of the thick plates 31 and cut across the end portion of the flat thin plates 29. The boss mount member 24 which is shown in FIGS. 2 and 12 is welded to these obliquely cut portions 27C by means of high energy density welding or the like.

Denoted at 32 is a U-shaped structure which is formed by bending the wide plate-like material 27. More particularly, the U-shaped structure 32 is formed by bending the thick plates 30 of the wide plate-like material 27 into a convexly curved shape along folding lines 30A indicated by broken lines in FIG. 3. As a result of plastic deformation of the thick wall plates, the wide plate-like material is folded into a U-shape in cross section as shown in FIG. 6 by a bending operation.

In the course of the bending operation, the right and left thick corner plates 30 bent into L-shape in cross section as shown in FIG. 6 to form corner portions 22A of the square tubular structure 22 as shown in FIG. 8. Further, the centrally located flat thin plate 28 defines an upper flat section 22B of the square tubular structure 22.

Figure 7:
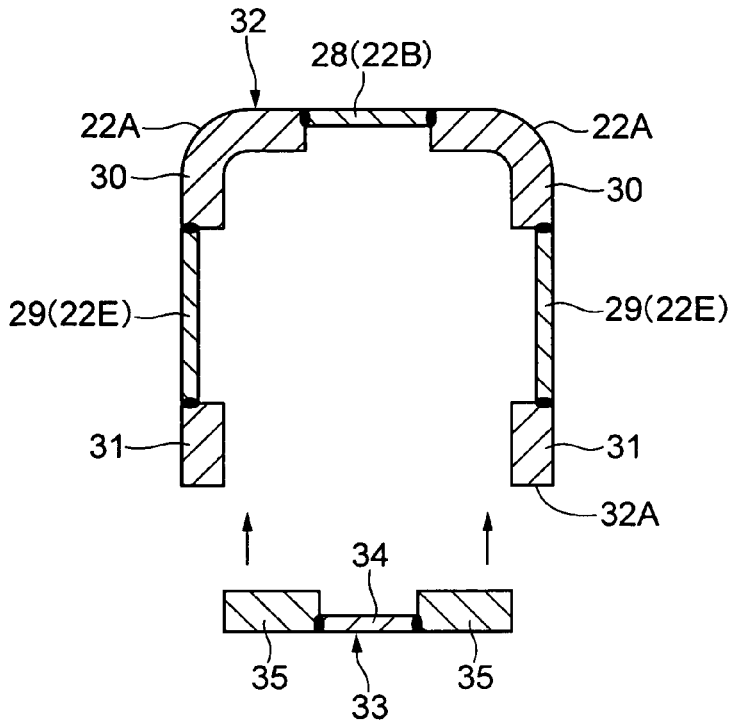
FIG. 7 is a sectional view of a plate-like member to be joined with the U-shaped structure.

The right and left flat thin plates 29 form the right and left flat sections 22E of the square tubular structure 22. As shown in FIG. 7, an opening 32A is formed on the lower side of the U-shaped structure 32 between the right and left thick plates 31. This opening 32A is closed by a plate-like member 33 which will be described hereinafter.

Figure 9:
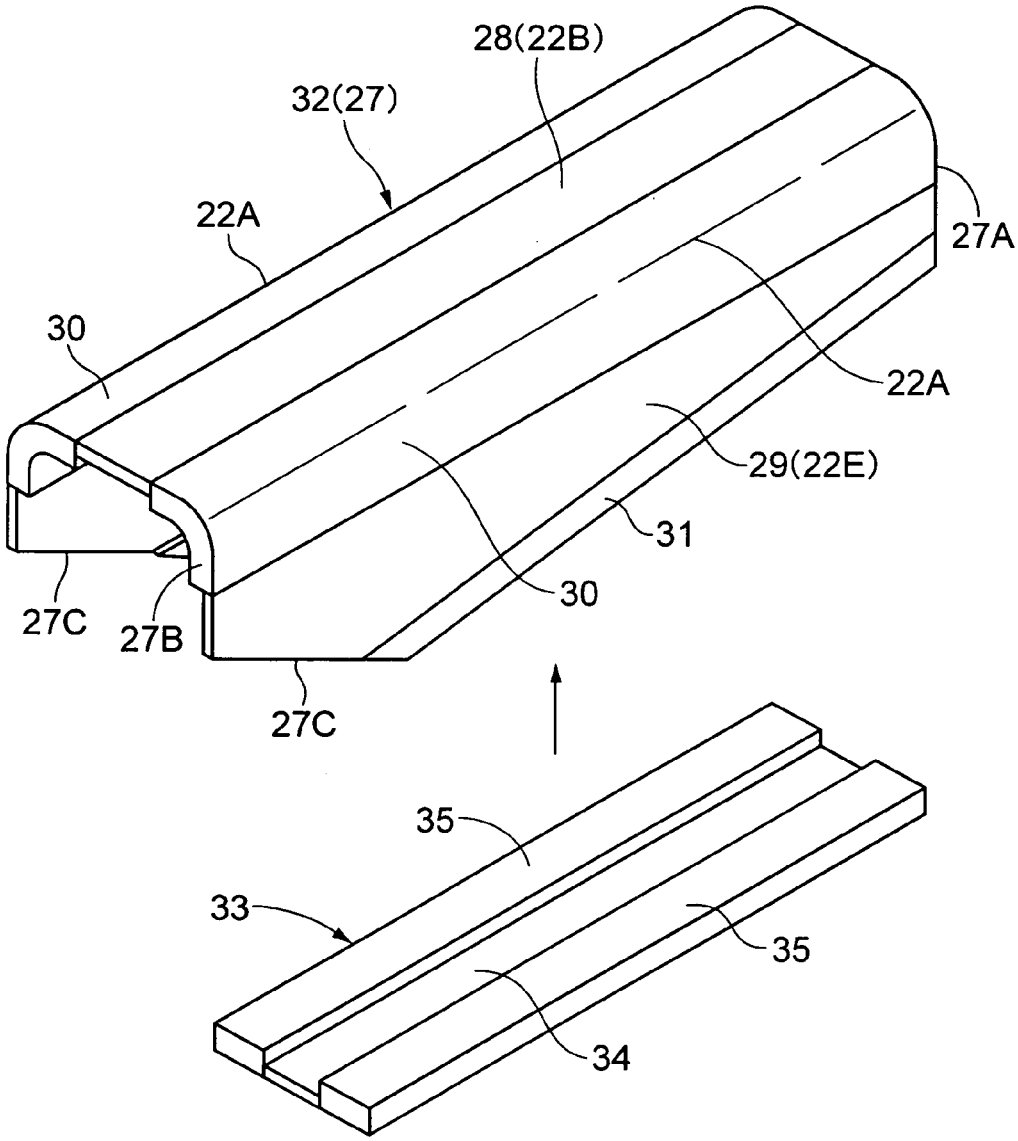
FIG. 9 is an exploded perspective view of the plate-like member and the U-shaped structure which are to be joined together.

Indicated at 33 is a plate-like member which constitutes the square tubular structure 22 together with the U-shaped structure 32. As shown in FIGS. 7 to 9, this plate-like member 33 is constituted by a centrally located thin plate 34, and right and left thick plates 35 which are joined side to side with the thin plate 34 by high energy density welding.

In this instance, as shown in FIG. 9, the plate-like member 33 is formed in a length which corresponds to the length of the thick plates 31 of the U-shaped structure 32, and, as shown in FIG. 7, in a width which corresponds to the width between the right and left thick plates 31. As shown in FIG. 7, the plate-like member 33 is fitted in the opening 32A (between the right and left thick plates 31) of the U-shaped structure 32, and, at joint portions 36 at the opposite sides, securely joined with the thick plates 31 by means of high energy density welding or the like.

As a consequence, the opening 32A of the U-shaped structure 32 is closed with the plate-like member 33 from beneath to form the square tubular structure 22 with a square cross-sectional shape as shown in FIG. 8. Right and left lower corner portion 22C are formed by the thick plates 31 of the U-shaped structure 32 and the thick plates 35 of the plate-like member 33 in the vicinity of the above-mentioned joint portions 36. A flat section 22D at the bottom of the square tubular structure 22 is defined by a lower surface of the plate-like member 33.

The thin wall plate 34 of the plate-like member 33 is formed substantially in the same thickness as the flat thin plates 28 and 29 of the wide plate-like material 27, while the thick plates 35 are formed substantially in the same thickness as the thick plates 30 and 31 of the wide plate-like material 27.

Indicated at 37 is a boss mounting thick plate to be formed into the boss mount member 23. This boss mounting thick plate 37 is formed in a shape as shown in FIG. 3, and in a thickness which is substantially same as the thick corner plates 30 and the thick plates 31 of the wide plate-like material 27. The boss mounting thick plate 37 is provided with a couple of boss mount holes 37A in which a tubular boss portion 23A fixedly set by welding as shown in FIG. 2, and a couple of semi-circular grooves 37B in which another tubular boss portion 23B is fixedly set by welding as shown in FIG. 2.

Figure 10:
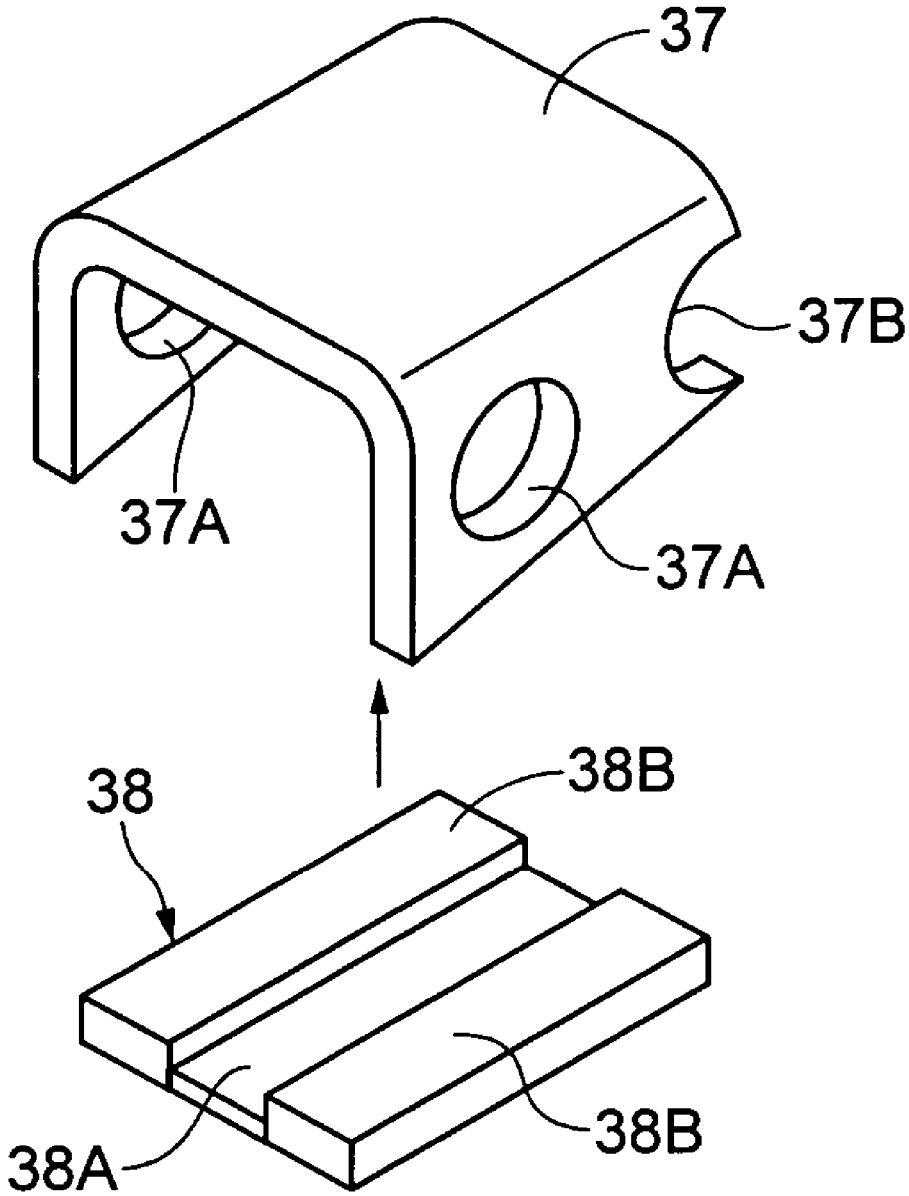
FIG. 10 is an exploded perspective view of the boss mounting thick plate for forming a boss mount member and a plate-like member to be joined together.

As shown in FIG. 10, the boss mounting thick plate 37 is bent along folding lines 37C indicated by broken lines in FIG. 3. This boss mounting thick plate is formed into U-shape in cross section, which is substantially similar to the above-described U-shaped structure 32.

Indicated at 38 is a plate-like member which makes up the boss mount member 23 together with the boss mounting thick plate member 37. Substantially in the same manner as the plate-like member 33 of the square tubular structure 22, the plate-like member 38 is composed of a centrally located thin plate 38A and right and left thick plates 38B as shown in FIG. 10. However, in correspondence to the boss mounting thick plate 37, the plate-like member 38 is formed in a short length, and joined with the boss mounting thick plate 37 being closed the lower side opening of the boss mounting thick plate 37.

Thus, by joining together the boss mounting thick plate 37 and the plate-like member 38, the boss mount member 23 is formed in a short square tubular structure which is square shape in cross section. Afterwards, the boss mount member 23 is joined with one longitudinal end of the square tubular structure 22, at a joining end 27A indicated in FIG. 2.

Figure 11:
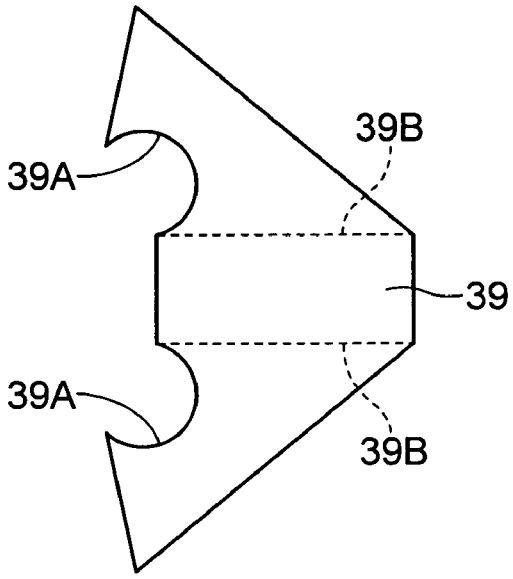
FIG. 11 is a plan view of another boss mounting thick plate for forming a boss mount member, different from the boss mounting thick plate of FIG. 10.

Designated at 39 is another boss mounting thick plate to be formed into the boss mount member 24. This boss mounting thick plate 39 is formed in the shape as shown in FIG. 11, and in a thickness which is same as that of the thick plates 30 and 31 of the wide plate-like material 27. Further, the boss mounting thick plate 39 is provided with a couple of semi-circular grooves 39A in which a tubular boss portion 24A is to be fixed by welding as shown in FIG. 2.

In this instance, along folding lines 39B indicated by broken lines in FIG. 11, opposite side portions of the boss mounting thick plate 39 are bent upward as shown in FIG. 12, and formed into the boss mount member 24 of U-shape in cross section. This boss mount member 24 is joined with the other longitudinal end of the square tubular structure 22 at the obliquely cut portions 27C shown in FIG. 2.

Being arranged as described above, the operating arm 21 of the hydraulic excavator 1 according to the present embodiment is fabricated by a method as follows.

In the first place, in a process of fabricating the square tubular structure 22 which constitutes a major part of the arm 21, as shown in FIGS. 3 and 4, the centrally located flat thin plate 28, the thick corner plates 30, the flat thin plates 29 and the outermost thick plates 31 are successively joined side to side butt welding, for example, by the use of a laser beam, to prepare the wide plate-like material 27 with alternately thin and thick wall portions in the transverse direction (First Welding Stage).

In the next place, the wide plate-like material 27 is bent on a press machine by the use of a die (not shown) to produce through plastic deformation a U-shaped structure 32 which is U-shaped in cross section as shown in FIGS. 6 and 9 (Bending Stage). At this time of forming the U-shaped structure 32 on a press, the right and left thick corner plates 30 of the wide plate-like material 27 are bent into a curved L-shape as shown in FIG. 6.

Further, separately from the U-shaped structure 32, the plate-like member 33 is prepared by joining thick plates 35 with the opposite right and left sides of the thin plate 34 by side to side butt welding as shown in FIG. 7. Then, the plate-like member 33 is joined with the side of opening 32A of the U-shaped structure 32 by laser welding in such a way as to close the opening 32A on the lower side of the U-shaped structure 32 (Second Welding Stage).

As a result of the foregoing operations, the square tubular structure 22 with a square cross-sectional shape as shown in FIG. 8 is produced from the U-shaped structure 32 and the plate-like member 33. Upper corner portions 22A on the upper side of the square tubular structure 22 are formed by the thick corner plates 30, and the upper flat section 22B is formed by the flat thin plate 28.

Further, lower corner portions 22C on the lower side of the square tubular structure 22 are formed at the joint portions 36 of the thick plates 31 and 35, and the lower flat section 22D is formed by the lower side of the plate-like member 33 (the thin plate 34). The flat sections 22E at the right and left lateral sides of the square tubular structure 22 are formed by the flat thin plates 29 between the thick plates 30 and 31.

In a process of fabricating the boss mount member 23, as shown in FIG. 3, by the use of a press means, for example, a couple of circular boss mount holes 37A and a couple of semi-circular grooves 37B are firstly bored in the boss mounting thick plate 37, a starting material for forming the boss mount member 23.

Thereafter, on a press machine, the boss mounting thick plate 37 is bent along the folding line 37C indicated by broken lines in FIG. 3, thereby shaping the boss mounting thick plate 37 into U-shape in cross section as shown in FIG. 10.

Separately from the boss mounting thick plate 37, the plate-like member 38 is prepared by joining thick plates 38B with the opposite sides of the thin plate 38A by end to end butt welding as shown in FIG. 10. Then, the plate-like member 38 is joined with the boss mounting thick plate 37 by laser welding in such a way as to close the opening on the lower side of the boss mounting thick plate 37.

As a result of the foregoing operations, the boss mount member 23 of a short square tubular form and of a square shape in cross section is formed from the boss mounting thick plate 37 and the plate-like member 38. The formed boss mount member 23 is joined with one longitudinal end of the square tubular structure 22 by laser welding at the position of a joining end 27A as shown in FIG. 2.

On the other hand, in a process of fabricating the boss mount member 24, as shown in FIG. 11, by the use of a press means, for example, a couple of semi-circular grooves 39A are firstly bored in the boss mounting thick plate 39, a starting material for forming the boss mount member 24.

Thereafter, the boss mounting thick plate 39 is bent on a press along folding lines 39B indicated by broken lines in FIG. 11. As a consequence, the boss mounting thick plate 39 is formed into U-shape in cross section as shown in FIG. 12. In the next place, the boss mount member 24 is joined with the other longitudinal end of the square tubular structure 22 by laser welding at the position of the obliquely cut portions 27C as shown in FIG. 2.

Further, as shown in FIG. 2, a lid plate 25 is joined with the other longitudinal end of the square tubular structure 22 by laser welding at the position of a joining end 27B. As a result, the other end portion of the square tubular structure 22 is closed with the lid plate 25.

A cylinder bracket 26 is welded to the outer side of the lid plate 25 in such a way as to extend toward the top side of the other end of the square tubular structure 22. Thus, the arm 21 which is intended for use of an operating arm of a construction machine is fabricated as shown in FIG. 2.

Similar to the arm 21, the above-described square tubular structure can be applied to other operating arms of a working mechanism, for example, to the lower boom 12 and the upper boom 13 of the working mechanism 11 shown in FIG. 1.

In the next place, the hydraulic excavator 1 with the offset boom type working mechanism 11 can be put in travel in the forward or reverse direction by driving the automotive base structure 2. The direction of the working mechanism 11 can be changed suitably by rotationally driving the revolving structure 3 on the automotive base structure 2.

At the time of a ground excavating operation, for example, the boom cylinder 16, arm cylinder 17 and bucket cylinder 20 are expanded or contracted thereby operating the lower boom 12, arm 21 and bucket 15 of the working mechanism 11 to carry out an excavating operation.

In the case of the offset boom type working mechanism 11, the upper boom 13 can be turned to the right or to the left of the lower boom 12 by expanding or contacting an offset cylinder (not shown). Accordingly, a side ditch or gutter can be dug easily by shifting the position of the arm 21 to the right or to the left of the lower boom 12.

Further, when the lower boom 12 of the working mechanism 11 is turned largely in the upward direction with the arm 21 and the bucket 15 folded inward toward the lower boom 12 as shown in FIG. 1, the working mechanism 11 as a whole can be retained within a turn radius of the revolving structure 3, permitting to carry out a digging operation smoothly without colliding against ambient obstacles even on a narrow working site.

Thus, according to the present embodiment, fabrication of the square tubular structure 22 which constitutes a major part of the arm 21 starts from the wide plate-like material 27 which has alternately thin and thick wall portions in the transverse direction and is prepared by joining thick corner plates 30 with the opposite right and left sides of the centrally located flat thin plate 28, and then joining the flat thin plates 29 and thick plates 31 successively side to side on the outer sides of the thick corner plates by laser welding as shown in FIGS. 3 and 4. Next, the wide plate-like material 27 is bent in L-shape at each one of the right and left thick corner plates 30, namely bent into U-shape as a whole to obtain a U-shaped structure 32 which is formed in U-shape in cross section as shown in FIGS. 6 and 9.

Separately from the U-shaped structure 32, the plate-like member 33 is prepared by joining the thick plates 35 with the opposite right and left sides of the thin plate 34 as shown in FIG. 7 by side to side butt welding. Next, the plate-like member 33 is joined with the side of the opening 32A of the U-shaped structure 32 by laser welding in such a way as to close the opening 32A on the lower side of the U-shaped structure 32 with the plate-like member 33, forming the square tubular structure 22 which is of a square shape in cross section as shown in FIG. 8.

As a consequence, there is obtained the square tubular structure 22, a major part of the arm 21, having upper corner portions 22A formed by the thick corner plates 30 and having a upper flat section 22B formed by the flat thin plate 28. Further, lower corner portions 22C of the square tubular structure 22 are formed in the vicinity of joint portions 36 between the thick plates 31 and 35, and a lower flat section 22D is formed by the lower side of the plate-like member 33 (the thin plate 34). Further, flat sections 22E at the opposite right and left lateral sides of the square tubular structure 22 are formed by the flat thin plates 29 between the thick plates 30 and 31.

According structural analysis conducted by the present inventors with regard to the operating arm (e.g., the arm 21), it has been revealed that the square tubular structure 22 should have a large wall thickness at the corner portions 22A and 22C to guarantee sufficient rigidity. However, the flat sections 22B, 22D and 22E between the corner portions 22A and 22C are in positions to take a smaller part in sharing loads as compared with the respective corner portions 22A and 22C. Namely, it has been found that the flat sections 22B, 22D and 22E are not necessarily required to be formed of a thick wall plate.

Therefore, in the present embodiment, the flat sections 22B, 22D and 22E of the square tubular structure 22 are formed by the use of thin plates 28, 29 and 34 for the purpose of reducing the total weight of the arm 21. Further, the corner portions 22A and 22C of the square tubular structure 22 are formed by the use of the thick corner plates 30 and the thick plates 31 and 35.

The above arrangements contribute to enhance the rigidity of the arm 21 as a whole. That is to say, the arm 21 has sufficient strength for sustaining digging reaction forces which are exerted from the side of the bucket 15 during a digging operation. In addition, since the square tubular structure 22 of the arm 21 is formed by the use of the steel plates which have alternatoly thin and thick wall portions, such as the thin plates 28, 29 and 34 in combination with the thick plates 30, 31 and 35, versatile plate materials can be employed for the fabrication of the arm 21.

Furthermore, the wide plate-like material 27, a preparatory material for fabrication of the square tubular structure 22, can be formed by butt welding alternately the thin plate 28 or 29 and the thick plate 30 or 31 prior to the bending stage forming into a U-shaped structure 32. These thin and thick plates can be welded together by a 2D welding operation.

In this regard, for example, the flat thin plate 28, right and left thick corner plates 30, right and left flat thin plates 29 and right and left thick plates 31, which are shown in FIG. 3, are laid out on a surface table. The respective plates are laid face down, namely, in a reversed state to lay on its outer or upper side thereof (the side which is shown on the upper side in FIG. 5).

By laying out the respective plates 28, 30, 29 and 31 on the same plane on a surface table as described above, they can be joined easily side to side in a facilitated manner by butt welding, that is to say, by 2D welding. Adoption of 2D welding makes positioning and alignment of joining parts far easier as compared with 3D welding adopted by the prior art mentioned hereinbefore. Besides, thanks to 2D welding, it is possible to carry out welding operations efficiently, forming welds of sufficient strength.

Further, by using high energy density welding like laser welding for deep penetration, the wide plate-like material 27 can be assembled with enhanced joint strength at the respective welded joints between the thin plate 28 or 29 and the thick plate 30 or 31. For example, it is possible to form a complete weld getting to back side of a material from front side.

High energy density welding like laser welding can improve fatigue life of welds as compared with partial penetration by arc welding or complete penetration by the use of a backing strip. In addition, high speed welding, approximately five times as high as arc welding, is possible, with suppressed input heat. As a consequence, high energy density welding can reduce occurrence of post-welding deformations, especially to plates which are smaller than 10 mm like the thin plates 28 and 29. In addition, the respective plates can be joined with sufficient joint strength against tensile loads which would be exerted in the bending stage.

Moreover, at the time of bending the wide plate-like material 27 into the U-shaped structure 32 as shown in FIG. 6, the side with indented surface portions, which are formed as a result of a difference in thickness between the flat thin plates 28 and 29 and the thick corner plates 30, is disposed on the inner side, without being exposed on the outer side of the U-shaped structure 32. Accordingly, on the outer side, the thin plates are joined substantially flush with outer surfaces of the thick plates, without forming indented portions on the outer side of the U-shaped structure 32, namely, on the outer side of the square tubular structure 22.

Further, as shown in FIGS. 7 and 9, at the time of welding the plate-like member 33 in the opening 32A of the U-shaped structure 32 by laser welding to form the square tubular structure 22 as shown in FIG. 8, the plate-like member 33 can be easily set in position simply by placing to the U-shaped structure 32 which is formed on a press having a corner angle of approximately 90° in such a way as to close the opening 32A.

Therefore, the U-shaped structure 32 and the plate-like member 33 can be easily set in position relative to each other also in the longitudinal direction of the U-shaped structure 32 as shown in FIG. 9. This contributes to improve the efficiency of welding operations to a marked degree. In addition, welds of sufficient strength can be formed thanks to complete welding by high energy density welding.

Thus, according to the present embodiment, the U-shaped structure 32 and the wide plate-like material 27 is formed by the use of plates of different thicknesses, i.e., the flat thin plates 28 and 29 and the thick corner plates 30 and the thick plates 31, and the square tubular structure 22 of a square cross-sectional shape is formed simply by joining the plate-like member 33 in the opening 32A of the U-shaped structure 32. As a result, it becomes possible to reduce the weight of the arm 21 as an operating arm, while securing sufficient rigidity of the arm.

In addition, the wide plate-like material 27 can be formed by joining the flat thin plates 28 and 29 with the thick corner plates 30 and thick plates 31 by 2D welding which is far simpler in positioning and aligning welding parts as compared with 3D welding. This means that welds of sufficient strength can be formed in an efficient manner.

Figure 13:
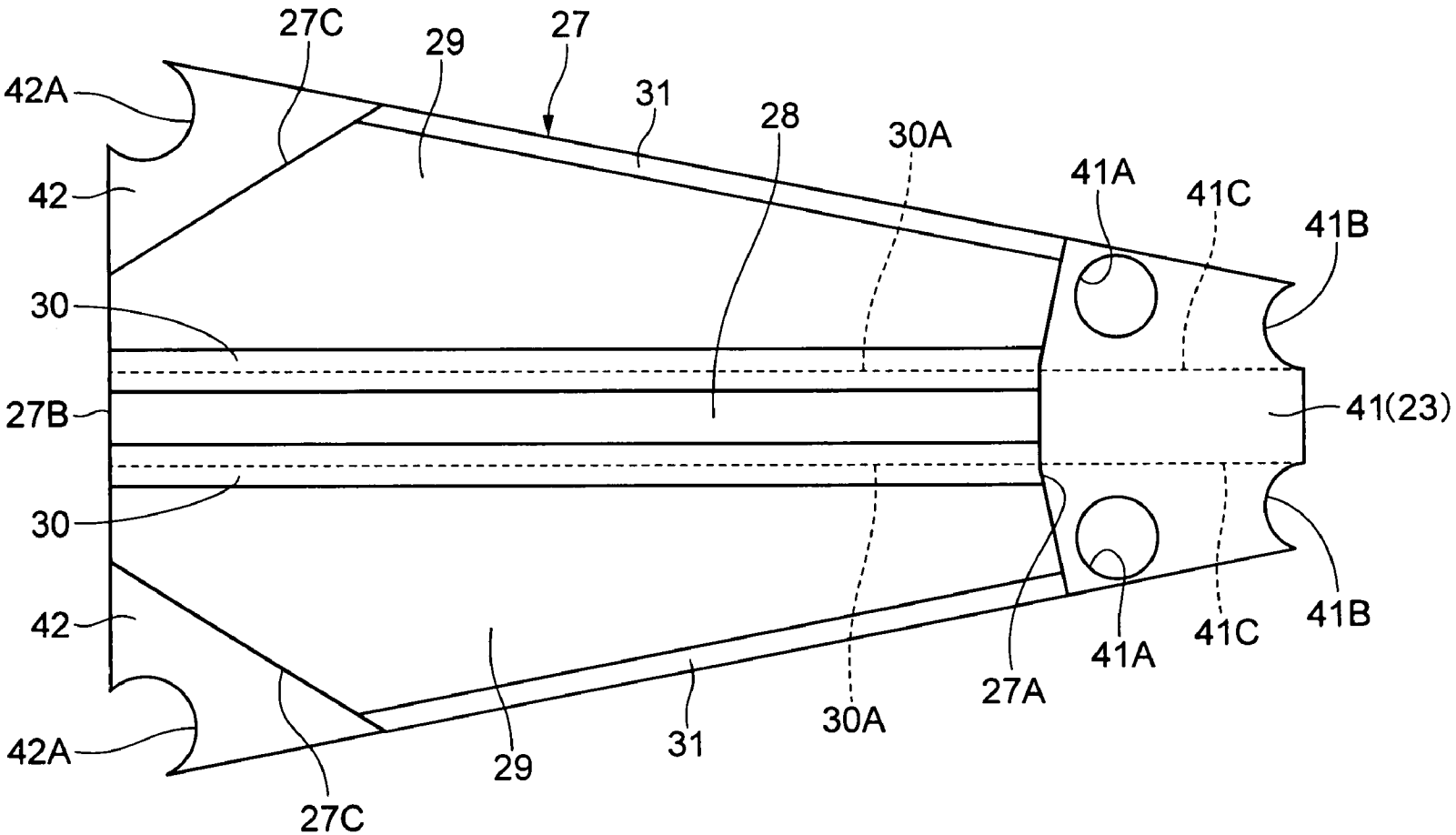
FIG. 13 is a plan view of a wide plate-like material and a boss mounting thick plate adopted in a second embodiment of the present invention.
Figure 14:
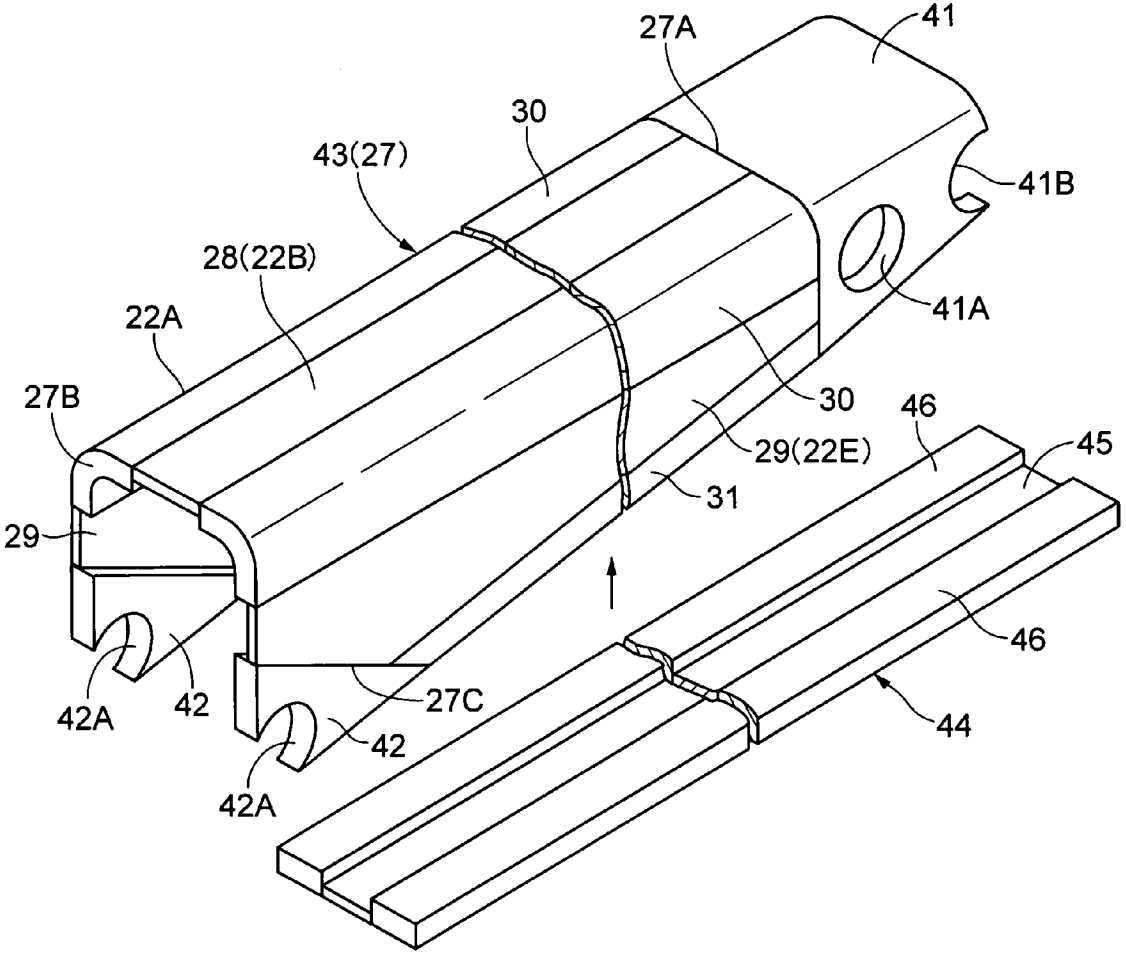
FIG. 14 is an exploded perspective view of a U-shaped structure which is formed by bending the wide plate-like material of FIG. 13, and a plate-like member to be joined with the U-shaped structure.

Now, turning to FIGS. 13 and 14, there is shown a second embodiment of the present invention. In the following description of the second embodiment, those component parts which are identical with the counterparts in the foregoing first embodiment are simply designated by the same reference numerals or characters to avoid repetitions of same explanations.

In short, a feature of this embodiment resides in that boss mounting thick plates 41 and 42 are joined with longitudinal ends of a wide plate-like material 27, which is composed of flat thin plates 28 and 29 and thick corner plate 30 and thick plates 31 (at a joining end 27A and obliquely cut portions 27C), and then the boss mounting thick plates 41 are bent together with the wide plate-like material 27.

In this instance, a couple of circular boss mount holes 41A and a couple of semi-circular boss mount grooves 41B are bored in the boss mounting thick plate 41 substantially in the same manner as the boss mounting thick plate 37 in the foregoing first embodiment. Along folding lines 41C indicated by broken lines in FIG. 13, the boss mounting thick plate 41 is bent to form a boss mount member 23 as shown in FIG. 2.

However, in the case of the boss mounting thick plate 41, it is joined with the joining end 27A of the wide plate-like material 27 by the use of the high energy density welding like laser welding before prior to a bending stage, and then bent together with the wide plate-like material 27 as shown in FIG. 14 to obtain a U-shaped structure 43, which will be described hereinafter.

Besides, in order to form boss mount member 24 as exemplified in FIG. 2, the other boss mounting thick plates 42 are adopted in the present embodiment in place of the boss mounting thick plates 39 in the foregoing first embodiment. Each one of the boss mounting thick plates 42 is formed substantially in a triangular shape as shown in FIG. 13, and substantially in the same thickness as the thick plates 30 and 31 of the wide plate-like material 27.

Further, the boss mounting thick plates 42 are each provided with a semi-circular boss mount groove 42A in which a boss portion 24A as exemplified in FIG. 2 is fixedly anchored by welding. These boss mounting thick plates 42 are joined with the other longitudinal end of the wide plate-like material 27 by laser welding or the like at obliquely cut portions 27C shown in FIG. 13.

Indicated at 43 is a U-shaped structure which is formed by bending a joined assembly of the wide plate-like material 27 and the boss mounting thick plates 41 and 42. This U-shaped structure 43 is shaped substantially in the same manner as the U-shaped structure 32 in the foregoing first embodiment, and joined with a plate-like member 44 later on to form a square tubular structure 22, which constitutes a major part of the arm 21.

However, in the case of the present embodiment, the U-shaped structure 43 is formed by joining the boss mounting thick plates 41 and 42 with the wide plate-like material 27 before pressing same into U-shape in cross section as shown in FIG. 14. Thus, in this case, the boss mounting thick plates 41 and 42 constitute part of the U-shaped structure 43.

Indicated at 44 is a plate-like member which is adopted in the present embodiment. This plate-like member 44 is formed substantially in the same manner as the plate-like member 33 in the foregoing first embodiment, and constituted by a centrally located thin plate 45, and right and left thick plates 46 which are joined with right and left lateral sides of the thin plate 45 by laser welding or the like.

In this instance, as shown in FIG. 14, the plate-like member 44 is formed in a length which approximately corresponds to the lengths of the thick plates 31, 41 and 42 of the U-shaped structure 43, and in a width which corresponds to the width of the spacing between the right and left thick plates 31. Further, the plate-like member 44 is fitted in the opening on the lower side of the U-shaped structure 43 (between the thick plates 31) and anchored between the thick plates 31 by laser welding or the like.

As a result, the opening on the lower side of the U-shaped structure 43 is closed with the plate-like member 44 to form a square tubular structure of a square shape in cross section similarly to the square tubular structure 22 in the above-described first embodiment.

Thus, substantially in the same manner as in the foregoing first embodiment, the wide plate-like material 27 and the U-shaped structure 43 are formed by the use of plates of different thicknesses, i.e., by the use of the thin plates 28 and 29 and the thick plates 30 and 31 which differ from each other in thickness, to provide the arm 21 which is reduced in weight and satisfactory in rigidity as an operating arm.

Especially, according to the present embodiment, the boss mounting thick plates 41 and 42 are welded to longitudinal ends of the wide plate-like material 27 which is composed of the thin plates 28 and 29 and the thick plates 30 and 31, and then the boss mounting thick plate 41 is bent into U-shape together with the wide plate-like material 27 to form the U-shaped structure 43.

Therefore, the boss mounting thick plate 41, to be formed into the boss mount member 23, can be bent together with the wide plate-like material 27 for reducing the number of steps and enhancing the efficiency of the arm fabrication process.

Besides, the boss mounting thick plates 41 and 42 which are joined with longitudinal ends of the wide plate-like material 27 serve to suppress adverse effects of loads in bending operation such as tensile loads and compression loads on the thin plates 28 and 29 of the wide plate-like material 27. Namely, the boss mounting thick plates 41 and 42 can be used as reinforcing members for the thin plates 28 and 29. Furthermore, since the boss mounting thick plate 41 is substantially same in thickness as the thick corner plates 30, stress and loads are uniformly distributed at the time of bending these plates together.

Figure 15:
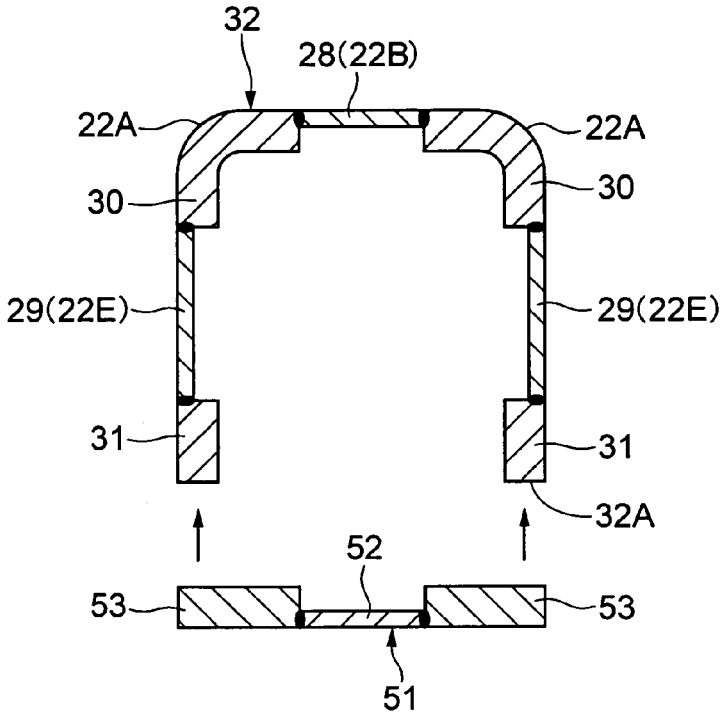
FIG. 15 is a sectional view of a U-shaped structure and a plate-like member adopted in a third embodiment of the present invention.
Figure 16:
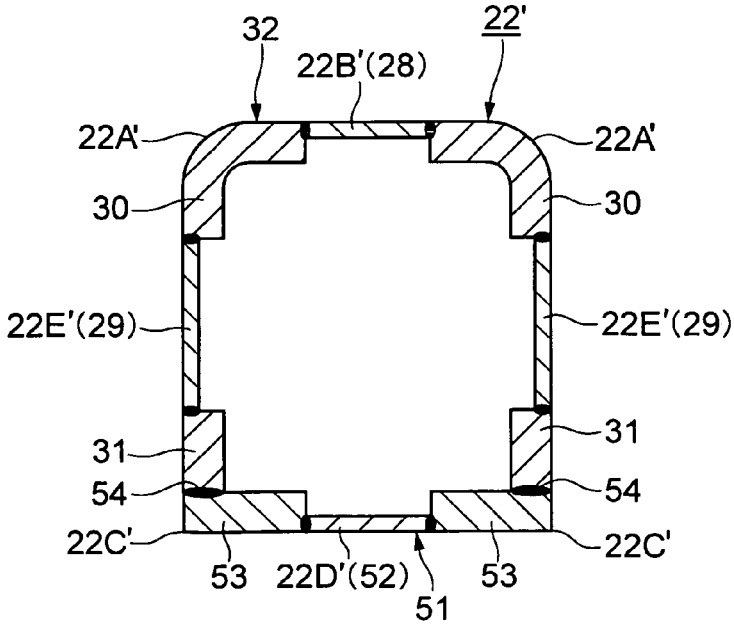
FIG. 16 is a sectional view of a square tubular structure which is formed by joining together the U-shaped structure and the plate-like member of FIG. 15.

Now, turning to FIGS. 15 and 16, there is shown a third embodiment of the present invention. In following description of the third embodiment, those component parts which are identical with the counterparts in the foregoing first embodiment are simply designated by the same reference numerals or characters to avoid repetitions of same descriptions.

In short, a feature of the third embodiment resides in that the opening 32A of the U-shaped structure 32 is closed with a plate-like member 51.

In this instance, similarly to the plate-like member 33 in the foregoing first embodiment, the plate-like member 51 is composed of a centrally located thin plate 52 and right and left thick plates 53. In this case, however, the plate-like member 51 is formed in a greater width than the afore-mentioned plate-like member 33, and the upper surfaces of the right and left thick plates 53 are abutted against the lower surfaces of the U-shaped structure 32 (the thick plates 31) at joint portions 54.

At the joint portions 54, the thick plates 53 of the plate-like member 51 are joined with the thick plates 31 of the lower side of the U-shaped structure 32 securely with deep penetration by laser welding. Thus, the opening 32A of the U-shaped structure 32 is closed with the plate-like member 51 to form a square tubular structure 22' of a square shape in cross section similarly to the square tubular structure 22 in the foregoing first embodiment.

Being arranged as described above, the present embodiment can produce substantially the same effects as the foregoing first embodiment. Particularly in this case, the corner portions 22A' on the upper side of the square tubular structure 22' can be formed of the thick corner plates 30, and an upper flat section 22B' can be formed of the flat thin plate 28.

Further, the corner portions 22C' on the lower side of the square tubular structure 22' can be formed in the vicinity of the joint portions 54 between the thick plates 31 and 53, and the lower flat section 22D' can be defined by the lower surface of the plate-like member 51 (the thin plate 52). On the other hand, the flat sections 22E' at the right and left lateral sides of the square tubular structure 22' can be formed by the thin plates 29 between the thick plates 30 and 31.

Figure 17:
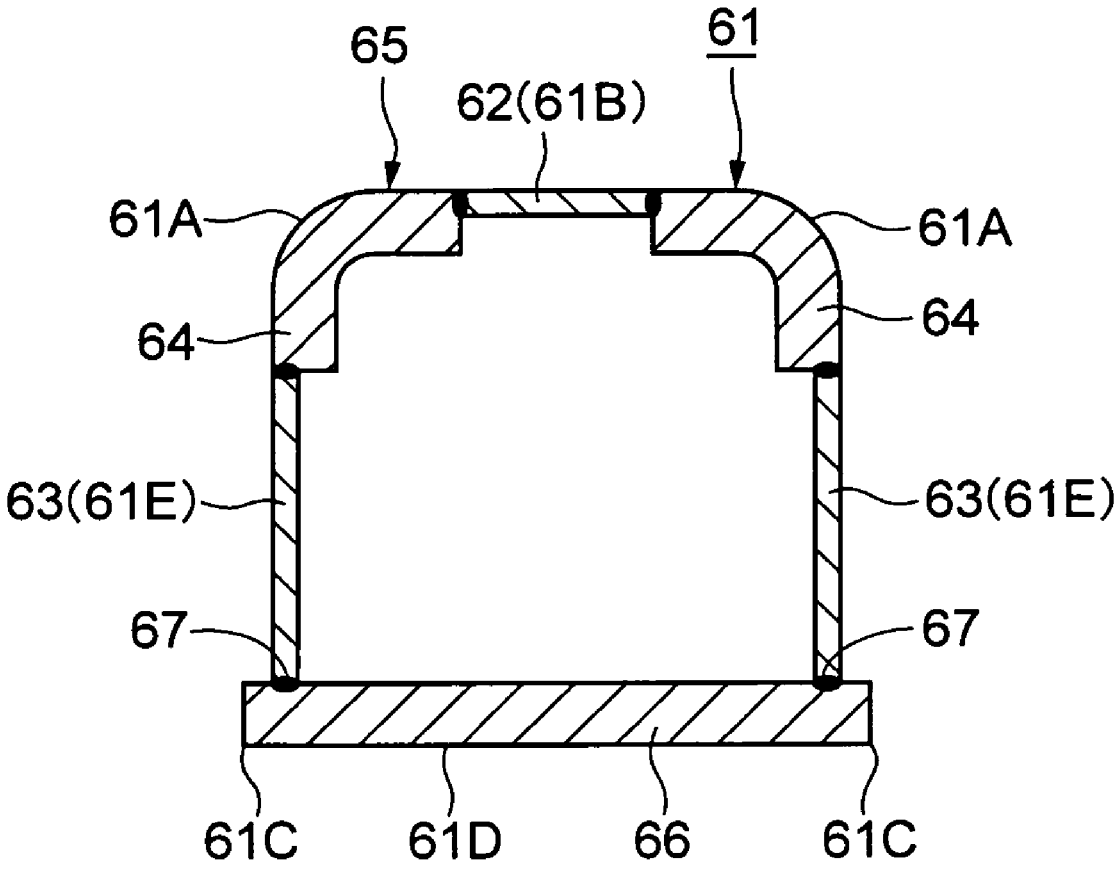
FIG. 17 is a sectional view of a square tubular structure which is formed by joining together a U-shaped structure and a plate-like member adopted in a fourth embodiment of the present invention.

Now, turning to FIG. 17, there is shown a fourth embodiment of the present invention. In the following description of the fourth embodiment, those component parts which are identical with counterparts in the foregoing first embodiment are simply designated by the same reference numerals or characters to avoid repetitions of same descriptions.

In short, a feature of the present embodiment resides in that a square tubular structure 61, which is a major part of the arm 21, is constituted by a U-shaped structure 65 which is composed of flat thin plates 62 and 63 and thick corner plates 64, and a plate-like member 66 which is joined to close an opening on the lower side of the U-shaped structure 65.

In this instance, similarly to the wide plate-like material 27 in the foregoing first embodiment, the flat thin plates 62 and 63 and the thick corner plates 64 are joined side to side by butt welding, and formed into the U-shaped structure 65 by bending at the positions of the thick corner plates 64 on a press.

The plate-like member 66 consists of a single steel plate which is same as the thick corner plate 64 in thickness and larger in width than the afore-mentioned plate-like member 33. An upper surfaces of the right and left side portions of the plate-like member 66 are abutted against the lower side of the U-shaped structure 65 (of the thin plates 63) and joined with the latter at joint portions 67.

The joint portions 67 are formed by welding opposite side portions of the plate-like member 66 to lower surfaces of the thin plates 63 of the U-shaped structure 65 by laser welding to form strong joint portions with deep penetration. As a consequence, the opening on the lower side of the U-shaped structure 65 is closed with the plate-like member 66 to form a square tubular structure 61 of a square shape in cross section similarly to the square tubular structure 22 in the first embodiment described above.

Being arranged in the manner as described above, the present embodiment can produce substantially the same effects as in the foregoing first embodiment. Particularly in this case, corner portions 61A on the upper side of the square tubular structure 61 are formed by the thick corner plates 64, and an upper flat section 61B is formed by the flat thin plate 62.

Further, corner portions 61C on the lower side of the square tubular structure 61 are formed in the vicinity of joint portions 67 between a thin plate 63 and the plate-like member 66, and a lower flat section 61D is defined by a lower surface of the plate-like member 66. On the other hand, flat sections 61E at the right and left lateral sides of the square tubular structure 61 are formed by the flat thin plates 63.

Now, turning to FIGS. 18 through 21, there is shown a fifth embodiment of the present invention. In the following description of the fifth embodiment, those component parts which are identical with counterparts in the foregoing first embodiment are simply designated by the same reference numerals or characters to avoid repetitions of same explanations.

Figure 21:
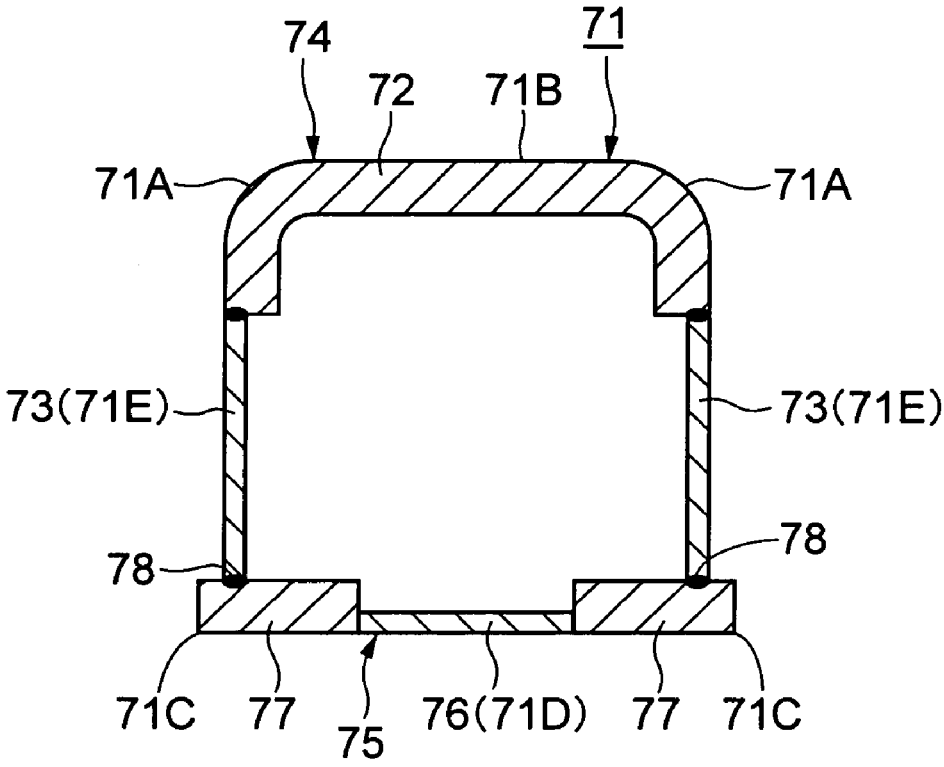
FIG. 21 is a sectional view of a square tubular structure formed by joining together the U-shaped structure and the plate-like member of FIG. 20.
Figure 22:
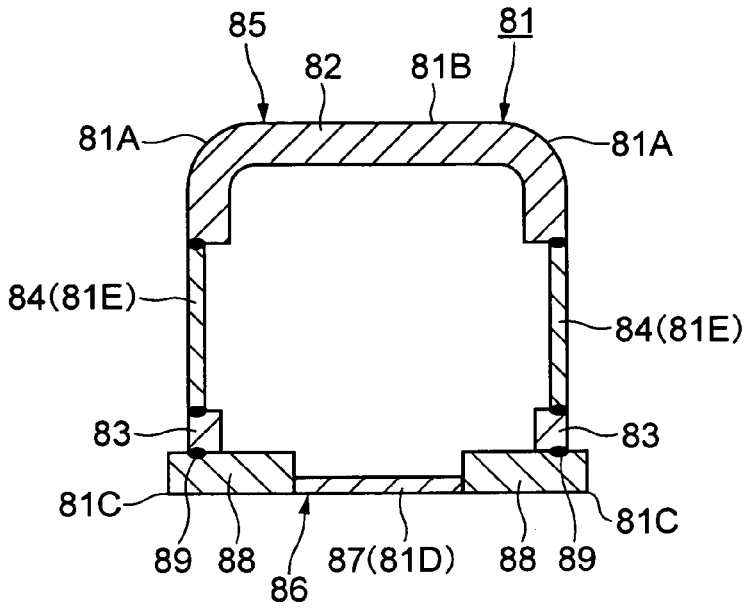
FIG. 22 is a sectional view of a square tubular structure which is formed by joining together a plate-like member and a U-shaped structure adopted in a sixth embodiment of the present invention.

In short, a feature of the present embodiment resides in that a square tubular structure 71, which is a major part of the arm 21, is formed by a U-shaped structure 74 which is composed of a thick corner plate 72 and right and left flat thin plates 73, and a plate-like member 75 which is joined in such a way as to close an opening on the lower side of the U-shaped structure 74, as shown in FIGS. 21 and 22.

Figure 18:
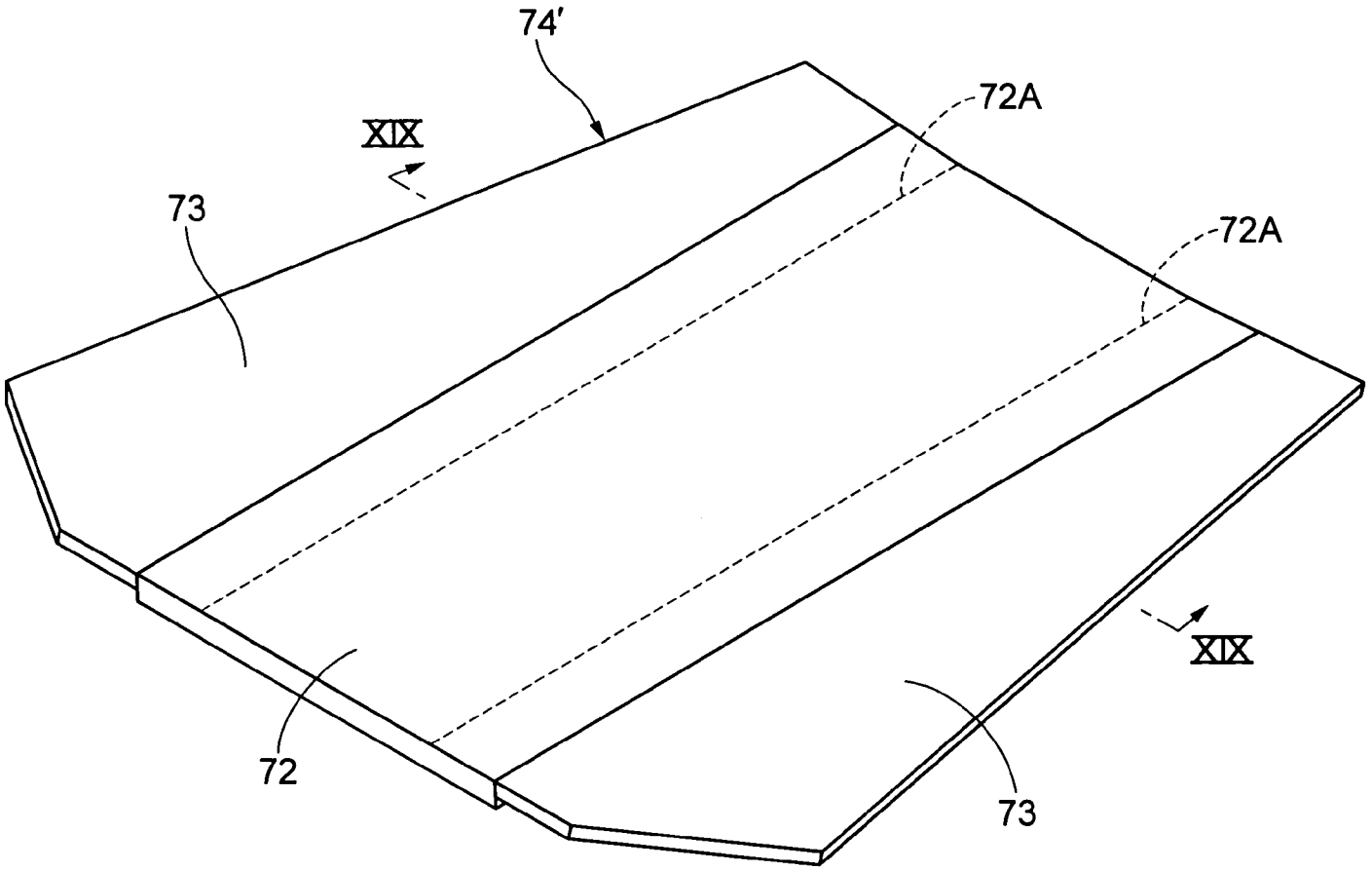
FIG. 18 is a perspective view of a wide plate-like material adopted in a fifth embodiment of the present invention for forming a square tubular structure.
Figure 19:
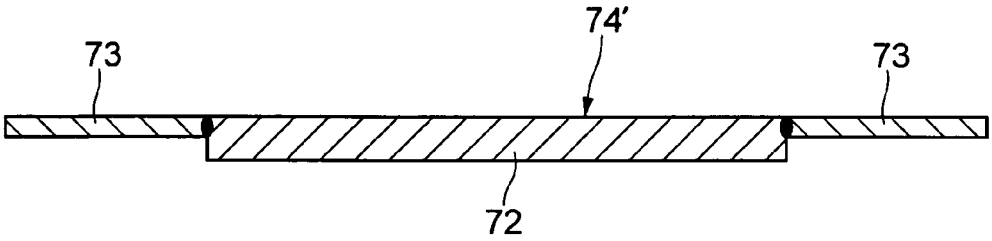
FIG. 19 is a sectional view of the wide plate-like material, taken in the direction of arrows XIX-XIX of FIG. 18.
Figure 20:
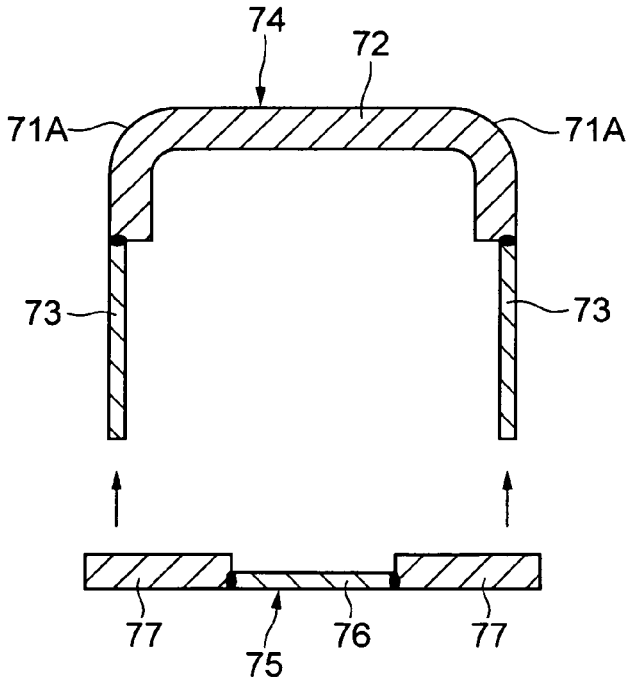
FIG. 20 is a sectional view of a U-shaped structure formed by bending the wide plate-like material in U-shape, and a plate-like member to be joined with the U-shaped structure.

In this instance, a wide plate-like material 74', which is a starting material to be formed into the U-shaped structure 74, is prepared substantially in the same manner as the wide plate-like material 27 in the first embodiment, namely, by welding thick corner plate 72 and flat thin plates 73 side to side as shown in FIGS. 18 and 19. Particularly in this case, the wide plate-like material 74' is formed into the U-shaped structure 74 on a press as shown in FIG. 20 by bending the thick corner plate 72 along folding lines 72A indicated by broken lines in FIG. 18.

Further, similarly to the plate-like member 33 in the first embodiment, the plate-like member 75 is composed of a centrally located thin plate 76 and right and left thick plates 77. However, in this case, the plate-like member 75 is formed in a larger width than the plate-like member 33, and the upper surfaces of the right and left thick plates 77 are abutted against the lower side of the U-shaped structure 74 (the thin plates 73) and joined with the latter at joint portions 78.

At the joint portions 78, the thick plates 77 of the plate-like member 75 are welded to the thin plates 73 on the lower side of the U-shaped structure 74 securely by laser welding with deep penetration. As a result, the opening on the lower side of the U-shaped structure 74 is closed with the plate-like member 75 to form a square tubular structure 71 of a square shape in cross section similarly to the square tubular structure 22 in the foregoing first embodiment.

Being arranged in the manner as described above, the present embodiment can produce substantially the same effects as the first embodiment. Particularly in this case, the corner portions 71A on the upper side of the square tubular structure 71 are formed by right and left portions of the thick corner plate 72, and an upper flat section 71B is formed by a transversely intermediate portion of the thick corner plate 72.

Further, corner portions 71C on the lower side of the square tubular structure 71 are formed in the vicinity of the joint portions 78 between a thin plate 73 and the plate-like member 75 (one of the thick plates 77), and a flat section 71D on the lower side is defined by a lower surface of the plate-like member 75 (the thin plate 76). On the other hand, flat sections 71E at the right and left lateral sides of the square tubular structure 71 are formed by the thin plate 73 as a flat thin plates.

Now, turning to FIG. 22, there is shown a sixth embodiment of the present invention. In the following description of the sixth embodiment, those component parts which are identical with counterparts in the foregoing first embodiment are simply designated by the same reference numerals or characters to avoid repetitions of same explanations.

In short, a feature of this embodiment resides in that a square tubular structure 81, which forms a major part of the arm 21, is constituted by a U-shaped structure 85 which is composed of thick corner plate 82, thick plates 83 and right and left flat thin plates 84, and a plate-like member 86 which is assembled in such a way as to close an opening on the lower side of the U-shaped structure 85.

In this instance, similarly to the wide plate-like material 74' of the foregoing fifth embodiment shown in FIGS. 18 and 19, the thick corner plate 82, the thick plates 83 and flat thin plates 84 are welded side to side beforehand, and then formed into U-shape by bending right and left portions of the thick corner plate 82 on a press to obtain a U-shaped structure 85.

Similarly to the plate-like member 33 in the first embodiment, the plate-like member 86 is composed of a centrally located thin plate 87 and right and left thick plates 88. Particularly in this case, however, the plate-like member 86 is formed in a larger width than the plate-like member 33, and the upper surfaces of the right and left thick plates 88 are abutted against the lower side of the U-shaped structure 85 (the thick plates 83) and joined with the latter at joint portions 89.

At the joint portions 89, the thick plates 88 of the plate-like member 86 are welded to the thick plates 83 on the lower side of the U-shaped structure 85 securely by deep penetration laser welding. As a result, the opening on the lower side of the U-shaped structure 85 closed by the plate-like member 86 to form a square tubular structure 81 of a square shape in cross section similarly to the square tubular structure 22 in the above-described first embodiment.

Being arranged in the manner as described above, the present embodiment can produce substantially the same effects as the foregoing first embodiment of the invention. Particularly in this case, the corner portions 81A on the upper side of the square tubular structure 81 are formed by right and left side portions of the thick corner plate 82, and an upper flat section 81B is formed by a transversely intermediate portion of the thick corner plate 82.

Further, the corner portions 81C on the lower side of the square tubular structure 81 are formed in the vicinity of the joint portions 89 between a thick plate 83 and the plate-like member 86 (a thick plate 88), and a lower flat section 81D is defined by a lower surface of the plate-like member 86 (the thin plate 87). On the other hand, flat sections 81E at the right and left lateral sides of the square tubular structure 81 are formed by the flat thin plates 84.

Figure 23:
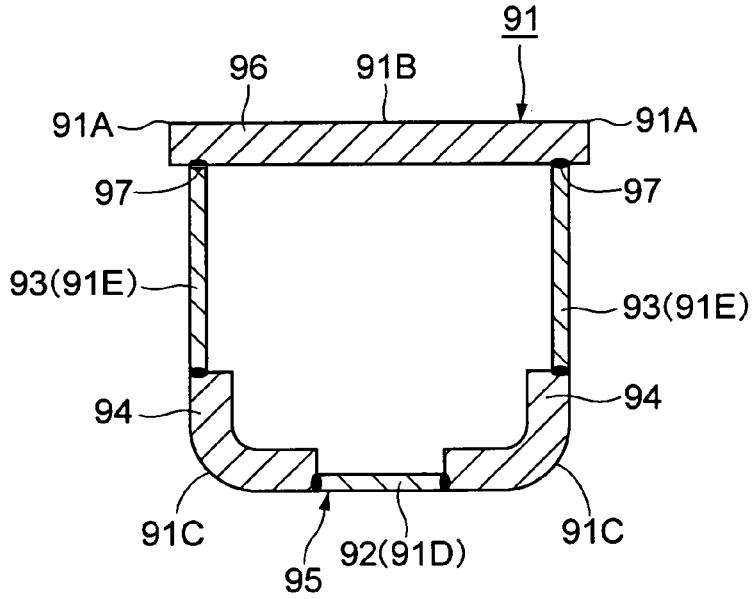
FIG. 23 is a sectional view of a square tubular structure which is formed by joining together a plate-like member and a U-shaped structure adopted in a seventh embodiment of the present invention.

Turning now to FIG. 23, there is shown a seventh embodiment of the present invention. In the following description of the seventh embodiment, those component parts which are identical with counterparts in the foregoing first embodiment are simply designated by the same reference numerals or characters to avoid repetitions of same descriptions.

In short, a feature of the present embodiment resides in that a square tubular structure 91, a major part of the arm 21, is constituted by a U-shaped structure 95 which is composed of flat thin plates 92 and 93 and thick corner plates 94, and a plate-like member 96 which is assembled to close an opening on the upper side of the U-shaped structure 95.

Namely, according to the present embodiment, the U-shaped structure 95 is located on the lower side of the plate-like member 96. The U-shaped structure 96 is formed in U-shape in cross section with an opening on the upper side as shown in FIG. 23, and the plate-like member 95 is securely assembled in such a way as to close the opening on the upper side of the U-shaped structure 95 at joint portions 97 as described below.

In this instance, similarly to the wide plate-like material 27 in the first embodiment, the flat thin plates 92 and 93 and the thick corner plates 94 are joined by side to side butt welding, and formed into U-shape on a press by bending the thick corner plates 94 as the flat thin plate 93 is turned up to obtain a U-shaped structure 95.

The plate-like member 96 is formed by a single steel plate which is similar to the thick corner plates 94 in thickness, and larger than the above-described plate-like member 33 in width, and the left and right portions of the plate-like member 96 is joined on its lower side with upper end faces of the U-shaped structure 95 (the flat thin plates 93) at joint portions 97.

More particularly, at joint portions 97, right and left side portions of the plate-like member 96 are joined with the thin plates 93 on the upper side of the U-shaped structure 95 securely by deep penetration laser welding. As a result, an opening of the U-shaped structure 95 is closed by the plate-like member 96 to form a square tubular structure 91 which is in a square shape in cross section similarly to the square tubular structure 22 in the foregoing first embodiment.

Being arranged in the manner as described above, the present embodiment can produce substantially the same effects as the above-described first embodiment. In this instance, the corner portions 91A on the upper side of the square tubular structure 91 are formed in the vicinity of the joint portions 97 between a flat thin plate 93 and the plate-like member 96. An upper flat section 91B is defined by an upper surface of the plate-like member 96.

Further, corner portions 91C on the lower side of the square tubular structure 91 are formed by the thick corner plates 94, and a lower flat section 91D is formed by the flat thin plates 92. On the other hand, flat sections 91E at the right and left lateral sides of the square tubular structure 91 are formed by the flat thin plates 93.

Turning now to FIGS. 24 through 28, there is shown an eighth embodiment of the present invention. In the following description of the eighth embodiment, those component parts which are identical with counterparts in the foregoing first embodiment are simply designated by the same reference numerals or characters to avoid repetitions of same explanations.

In short, a feature of the present embodiment resides in that flat thin plates and thick corner plates are joined by side to side butt welding such that surfaces of the respective plates are disposed substantially flush with each other on one side but indented on the other side at the positions of the thin and thick plates.

Figure 28:
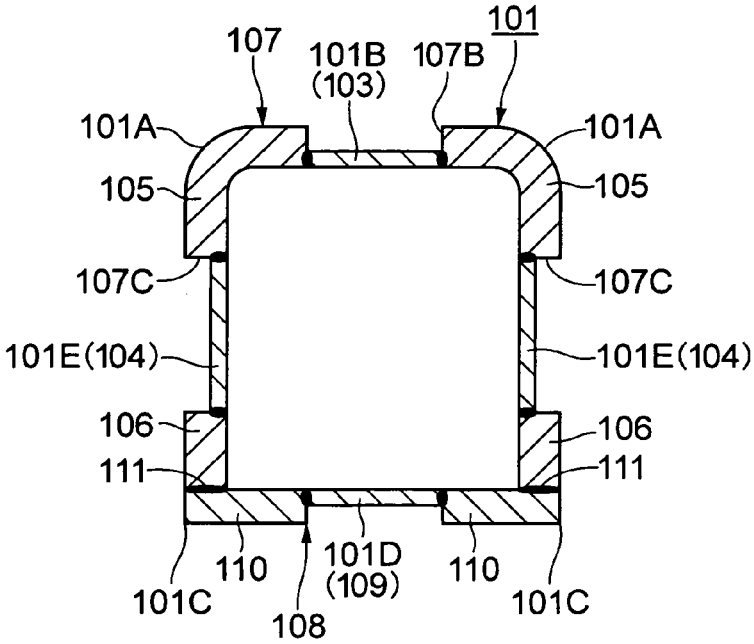
FIG. 28 is a sectional view of a square tubular structure which is formed by joining together the U-shaped structure and the plate-like member of FIG. 26.

In the drawings, indicated at 101 is a square tubular structure which is adopted by the present embodiment. This square tubular structure 101 is formed substantially in the same manner as the square tubular structure 22 in the first embodiment. In this instance, as shown in FIG. 28, the square tubular structure 101 is constituted by right and left upper corner portions 101A, an upper flat section 101B which is formed between the right and left upper corner portions 101A, right and left lower corner portions 101C, a lower flat section 101D which is formed between the lower corner portions 101C, and right and left side flat sections 101E which are formed between upper and lower corner portions 101A and 101C.

Figure 24:
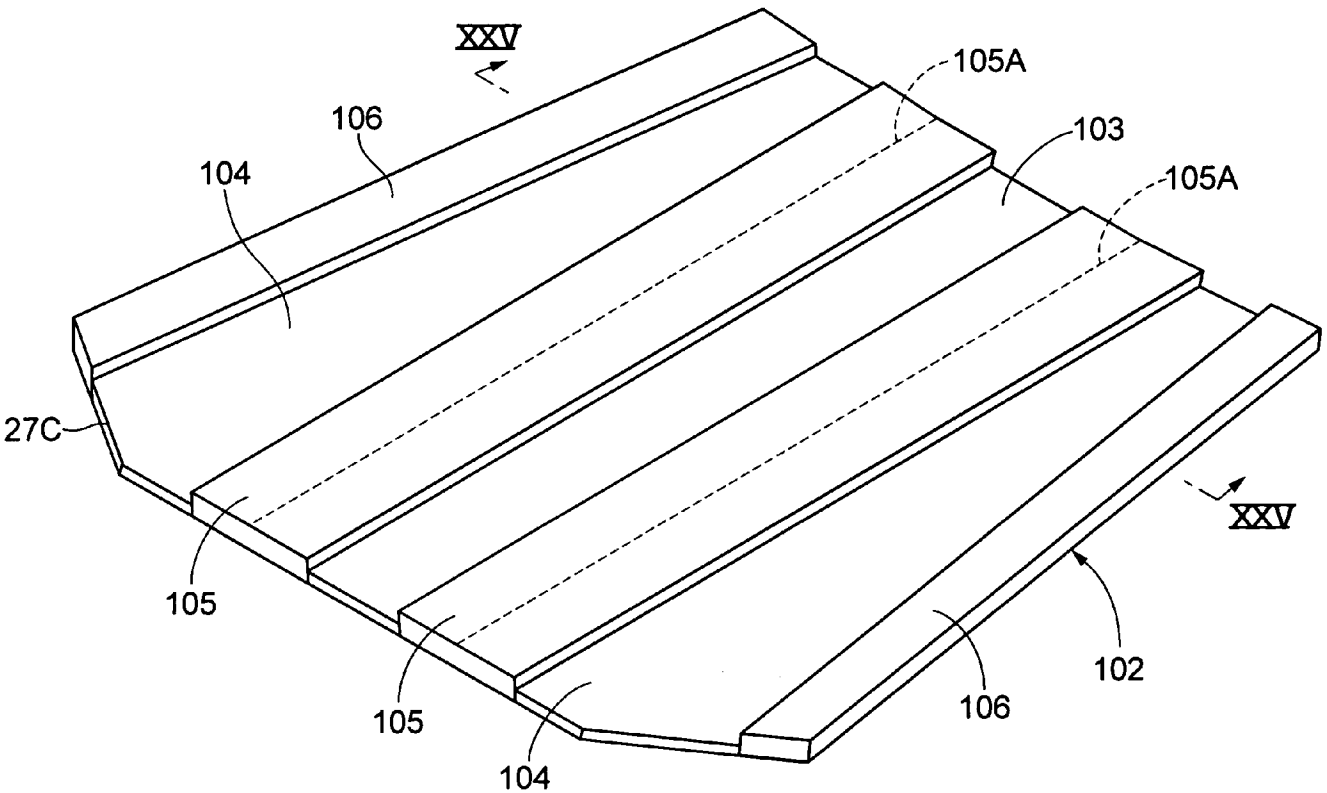
FIG. 24 is a perspective view of a wide plate-like material adopted in an eighth embodiment of the present invention for forming a square tubular structure.
Figure 25:
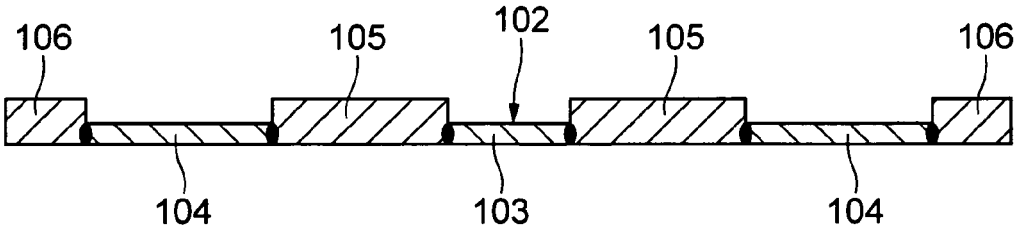
FIG. 25 is a sectional view of the wide plate-like material, taken in the direction of arrows XXV-XXV of FIG. 24.

Indicated at 102 is a wide plate-like material to be formed into a square tubular structure 101. This wide plate-like material 102 is formed substantially in the same manner as the wide plate-like material 27 in the above-described first embodiment. In this instance, as shown in FIGS. 24 and 25, the wide plate-like material 102 is formed by alternately joining one of flat thin plates 103 and 104 and one of thick corner plates 105 and thick plates 106 by side to side butt welding. In this regard, the respective plates are butt joined by high energy density welding like laser welding which can ensure deep penetration.

At the time of welding together the respective plate materials for preparation of the wide plate-like material 102, the flat thin plates 103 and 104 are disposed substantially flush with the thick corner plates 105 and thick plates 106 on one side (on the lower side), but surfaces of the thin and thick plates are indented on the other side (on the upper side).

Indicated at 107 is a U-shaped structure which is formed by bending the wide plate-like material 102. This U-shaped structure 107 is formed by bending the thick corner plates 105 of the wide plate-like material 102 into a convexly curved shape along folding lines 105A indicated by broken lines in FIG. 24, and is formed into U-shape in cross section through plastic deformation as shown in FIGS. 26 and 27.

Figure 26:
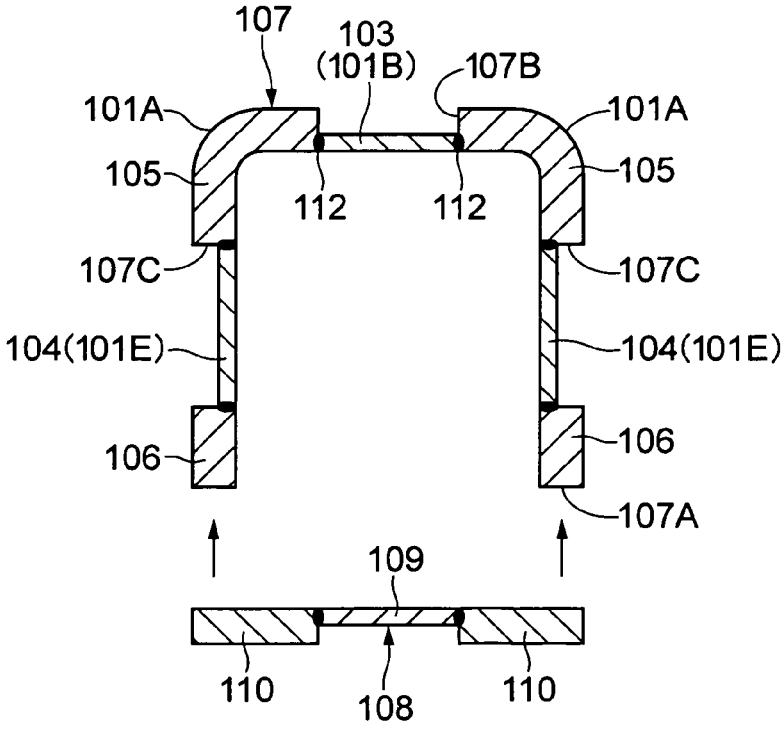
FIG. 26 is a sectional view of a U-shaped structure formed by bending the wide plate-like material of FIG. 25, and a plate-like member to be joined with the U-shaped structure.
Figure 27:
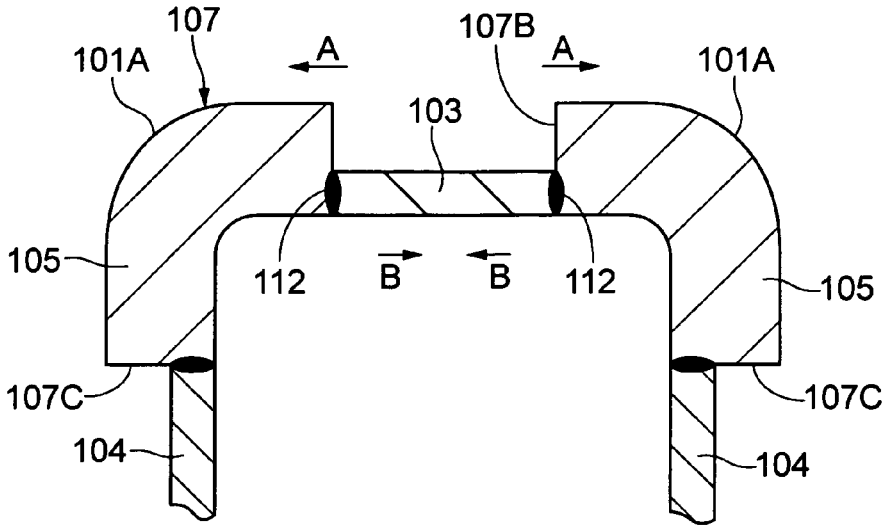
FIG. 27 is a fragmentary sectional view, showing part of the U-shaped structure of FIG. 26 on an enlarged scale.

As a bending operation proceeds, the right and left thick corner plates 105 are bent into L-shape in cross section as shown in FIG. 26 to make corner portions 101A of a square tubular structure 101 shown in FIG. 28. The centrally positioned flat thin plate 103 defines an upper flat section 101B of the square tubular structure 101.

Further, the right and left flat thin plates 104 define flat sections 101E at the right and left lateral sides of the square tubular structure 101. As shown in FIG. 26, an opening 107A is formed on the lower side of the U-shaped structure 107 between the right and left thick plates 106. The opening 107A is closed by a plate-like member 108, which will be described below.

Outer surfaces of the U-shaped structure 107 contain raised and indented surfaces 107B and 107C which are attributable to the difference in thichness between the flat thin plates 103 and 104 and the thick corner plates 105. The inner surface of the U-shaped structure 107 is joined flush with surfaces.

Indicated at 108 is a plate-like member which makes up the square tubular structure 101 together with the U-shaped structure 107. As shown in FIG. 26, the plate-like member 108 is composed of a centrally positioned thin plate 109 and right and left thick plates 110 which are joined side to side with the thin plate 109 by high energy welding or the like.

In this instance, as shown in FIG. 26, the thin plate 109 in the center position is joined with the right and left thick plates 110 by side to side butt welding such that its surface is disposed substantially flush with the right and left thick plates on the upper side but indented on the lower side of the plate-like member 108.

The plate-like member 108 is abutted against the opening 107A of the U-shaped structure 107 (against lower ends of the thick plates 106) and securely joined with the thick plates 106 at joint portions 111 by high energy density welding as shown in FIG. 28.

As a result, the opening 107A of the U-shaped structure 107 is closed with the plate-like member 108 to form a square tubular structure 101 which is of a square shape in cross section as shown in FIG. 28. Lower right and left corner portions 101C of the square tubular structure 101 are formed in the vicinity of the joint portions 111 between a thick plate 106 of the U-shaped structure 107 and a thick plate 110 of the plate-like member 108, and a flat section 101D on the lower side of the square tubular structure 101 is defined by a lower surface of the plate-like member 108.

Being arranged in the manner as described above, the present embodiment can produce substantially the same effects as the foregoing first embodiment. Particularly in the case of the present embodiment, at the time of preparing the wide plate-like material 102 by side to side butt welding, the flat thin plates 103 and 104 are disposed substantially flush with the thick corner plates 105 and thick plates 106 on the lower side but indented on the upper side of the wide plate-like material 102 as seen in FIGS. 24 and 25.

Therefore, in this case it becomes possible to prevent exertion of tensile loads at the joint portions 112 between the flat thin plate 103 and the thick corner plates 105 at the time of bending the thick corner plates 105 of the wide plate-like material 102 into a convexly curved shape on a press to form a U-shaped structure 107 as shown in FIG. 27, thus preventing development of cracks between the joint portions 112.

Namely, when the thick corner plates 105 are bent on a press, there is a tendency that tensile loads are exerted on the outer side of the U-shaped structure 107 (on the side of the raised and indented surface 107B) as indicated by arrows A in FIG. 27, and compressive loads are exerted on the inner side of the U-shaped structure 107 as indicated by arrows B. In this case, however, the flat thin plate 103 is joined substantially flush with the thick corner plates 105 on the inner side and indented from a raised and indented surface 107B on the outer side.

As a consequence, the joint portions 112 between the flat thin plate 103 and the thick corner plates 105 are almost free from actions of tensile loads in the direction of arrows A, and free from degradations in strength which would otherwise be caused under the influence of tensile loads. Conversely, compressive loads in the direction of arrows B are exerted on the joint portions 112 between the flat thin plate 103 and the thick corner plates 105. However, no adverse effects are imposed on the joint portions 112 by the compressive loads. Namely, in contrast to the tensile loads in the direction of arrows A which tend to pull apart the joint portions 112, the compressive loads in the direction of arrows B as shown FIG. 27 do not act to impose any adverse effects on the joint portions 112.

It follows that the joint portions 112 are prevented from rupturing and allowed to retain sufficient strength. As compared with the U-shaped structure 32 in the foregoing first embodiment, the joint portions 112 of the U-shaped structure 107 are more reliably reduced in residual tensile stress and are markedly improved in resistance to cracking and fatigue life.

Further, in this case, the raised and indented surfaces 107B and 107C, which are attributable to the difference in thickness between the flat thin plate 103 or 104 and the thick corner plate 105, are exposed on the outer side of the square tubular structure 101 to form the U-shaped structure 107. These raised and indented surfaces 107B and 107C can be used to give certain design effects to the outer side of the square tubular structure 101, for example, sturdiness in design, for the purpose of attaching an enhanced commercial value to the square tubular structure 101 as an operating arm of a construction machine.

Figure 29:
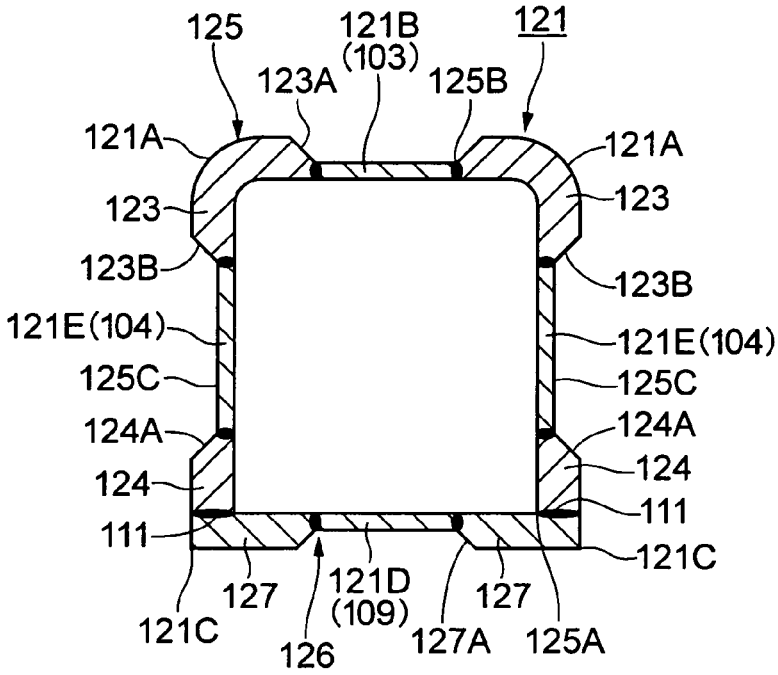
FIG. 29 is a sectional view of a square tubular structure which is formed by joining together a U-shaped structure and a plate-like member adopted in ninth embodiment of the present invention.
Figure 30:
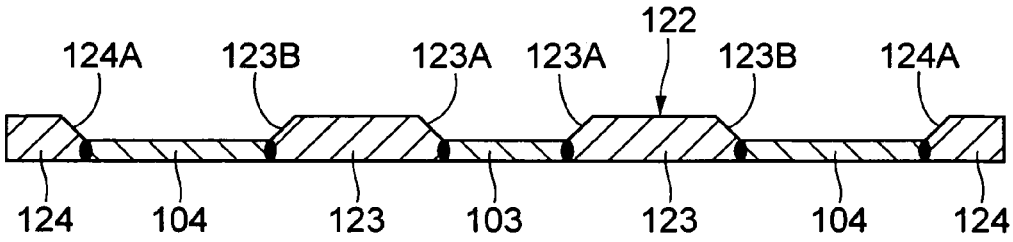
FIG. 30 is a sectional view similar to FIG. 5, but showing a wide plate-like material before it is bent into the U-shaped structure shown in FIG. 29.

Turning now to FIGS. 29 and 30, there is shown a ninth embodiment of the present invention. In the following description of the ninth embodiment, those component parts which are identical with counterparts in the foregoing eighth embodiment are simply designated by the same reference numerals or characters to avoid repetitions of same explanations.

In short, a feature of the present embodiment resides in that a wide plate-like material 122, to be formed into a square tubular structure 121, is prepared by the use of thick corner plates 123 as shown in FIG. 30. Side edges of the thick corner plates 123 are chamfered to provide sloped surfaces 123A and 123B.

In this instance, the wide plate-like material 122 is formed by alternately joining one of flat thin plates 103 and 104 and one of thick corner plates 123 and thick plates 124 by side to side butt welding substantially in the same manner as the wide plate-like material 102 in the foregoing eighth embodiment.

Particularly in the case of the present embodiment, however, the wide plate-like material 122 differs from the counterpart in the preceding embodiment in that the thick corner plates 123 are each provided with sloped surfaces 123A and 123B at opposite side edges. In addition, in this case, each one of the thick plates 124 of the wide plate-like material 122 is provided with a sloped surface 124A.

In this case, the wide plate-like material 122 is also formed by bending the thick corner plates 123 on a press to fabricate a U-shaped structure 125 which is U-shape in cross section. An opening 125A on the lower side of the U-shaped structure 125 is closed by a plate-like member 126 as shown in FIG. 29.

In this instance, similarly to the plate-like member 108 in the foregoing eighth embodiment, the plate-like member 126 is composed of a centrally located thin plate 109 and right and left thick plates 127. In this particular case, however, each one of the thick plates 127 of the plate-like member 126 is provided with a chamfered or sloped surface 127A at a side edge.

Outer surfaces of the square tubular structure 121 (the U-shaped structure 125) contain raised and indented surfaces 125B and 125C which are attributable to the difference in thickness between the flat thin plates 103 and 104 and the thick courner plates 123. The inner side of the square tubular structure 121 are joined flush with surfaces.

Being arranged in the manner as described above, the present embodiment can produce substantially the same effects as the foregoing eighth embodiment. Particularly in this case, the corner portions 121A on the upper side of the square tubular structure 121 are formed by the thick corner plates 123, and an upper flat section 121B is formed by the flat thin plate 103.

Further, the corner portions 121C on the lower side of the square tubular structure 121 are formed in the vicinity of the joint portions 111 between the thick plates 124 and the plate-like member 126, and a lower flat section 121D is defined by the lower side of the plate-like member 126. The flat sections 121E at the right and left lateral sides of the square tubular structure 121 are formed by the flat thin plates 104.

In this particular embodiment, however, right and left side edges of each one of the thick corner plates 123 are chamfered into the sloped surfaces 123A and 123B, and each one of the thick plates 124 and 127 is provided with a sloped surface 124A or 127A. Edges of raised and indented surfaces 125B and 125C which are exposed on the outer side of the square tubular structure 121 (the U-shaped structure 125) are smoothened by the sloped surfaces 123A, 123B, 124A and 127A to add to a commercial value as an operating arm of a construction machine.

Now, turning to FIGS. 31 to 34, there is shown a tenth embodiment of the present invention. In the following description of the tenth embodiment, those component parts which are identical with counterparts in the foregoing first embodiment are simply designated by the same numeral or characters to avoid repetitions of same explanations.

In short, a feature of the present embodiment resides in that flat thin plates and thick corner plates are alternately joined by side to side butt welding in such a way as to form raised and indented surfaces on both sides in a direction of thickness of a wide plate-like material.

Figure 31:
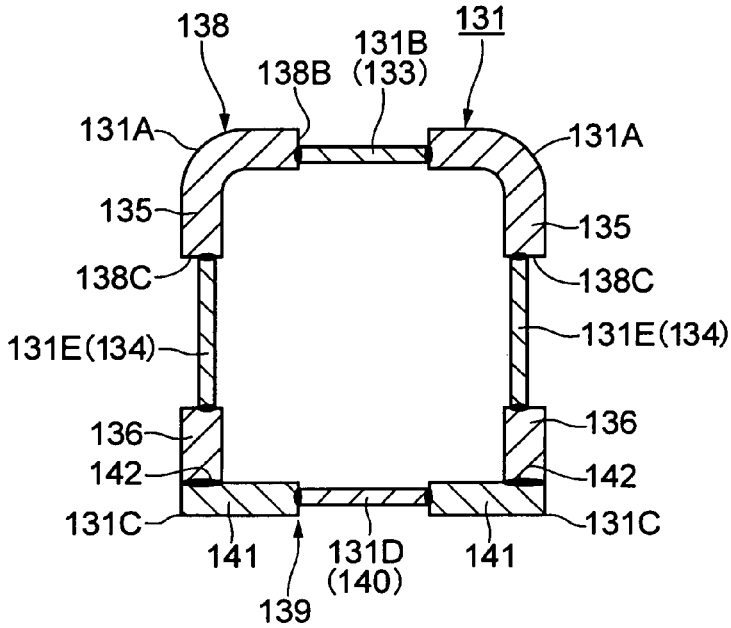
FIG. 31 is a sectional view of a square tubular structure which is formed by joining together a U-shaped structure and a plate-like member adopted in a tenth embodiment of the present invention.

In the drawings, indicated at 131 is a square tubular structure which is adopted by the present embodiment. This square tubular structure 131 is formed substantially in the same manner as the square tubular structure 22 in the foregoing first embodiment, and, as shown in FIG. 31, constituted by right and left upper corner portions 131A, an upper flat section 131B which is located between the each upper corner portions 131A, right and left lower corner portions 131C, a lower flat section 131D which is located between the each lower corner portions 131C, and right and left flat sections 131E which are located between an upper corner portion 131A and a lower corner portion 131C.

Figure 32:
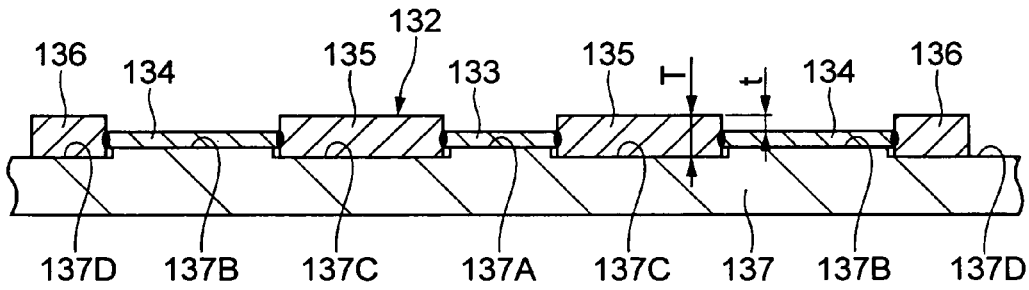
FIG. 32 is a sectional view similar to FIG. 5, but showing a wide plate-like material before it is bent into the U-shaped structure shown in FIG. 31.

Indicated at 132 is a wide plate-like material to be formed into a square tubular structure 131. The wide plate-like material 132 is formed substantially in the same manner as the wide plate-like material 27 in the first embodiment. In this instance, as shown in FIG. 32, the wide plate-like material 132 is formed by alternately joining one of flat thin plates 133 and 134 and one of thick corner plates 135 and thick plates 136 by side to side butt welding. More specifically, the respective plates are joined with each other by high energy density welding, for example, by deep penetration laser welding.

Particularly in this case, the flat thin plates 133 and 134, the thick corner plates 135 and the thick plates 136 are aligned and joined at intermediate positions in the direction of thickness as to form raised and indented surfaces on both sides in the direction of thickness (the upper and lower sides) for the wide plate-like material 132, as shown in FIG. 32.

Denoted at 137 is a jig table for use in preparing the wide plate-like material 132. As shown in FIG. 32, the upper surface of the jig table 137 is provided with heightened surfaces 137A and 137B at positions corresponding to the positions of the flat thin plates 133 and 134, and alternately provided with a sunken surface 137C and 137D between heightened surfaces 137A and 137B.

Prior to welding operation, flat thin plates 133 and 134 are placed on the heightened surfaces 137A and 137B of the jig table 137, respectively, and thick corner plates 135 and thick plates 136 are placed on the sunken surfaces 137C and 137D, respectively. At this time, as shown in FIG. 32, the flat thin plates 133 and 134 are set at positions which are lower than those of the thick corner plates 135 and the thick plates 136 by a dimension t. In this instance, for example, the dimension t is preferably set approximately at a value of ½ (t=T/2) where T stands for the thickness of the thick corner plates 135 and thick plates 136.

Figure 33:
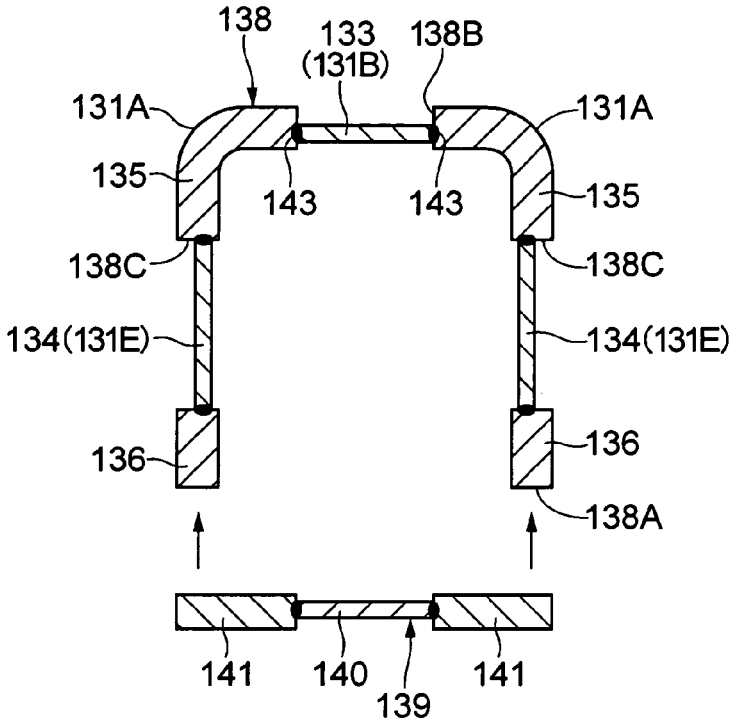
FIG. 33 is a sectional view of a U-shaped structure which is formed by bending the wide plate-like material of FIG. 32, and a plate-like member to be joined with the U-shaped structure.

Indicated at 138 is a U-shaped structure which is formed by bending the wide plate-like material 132. This U-shaped structure 138 is formed by bending the thick corner plates 135 of the wide plate-like material 132 into a convexly curved shape on a press, fabricating through plastic deformation which is U-shape in cross section as shown in FIGS. 33 and 34.

Figure 34:
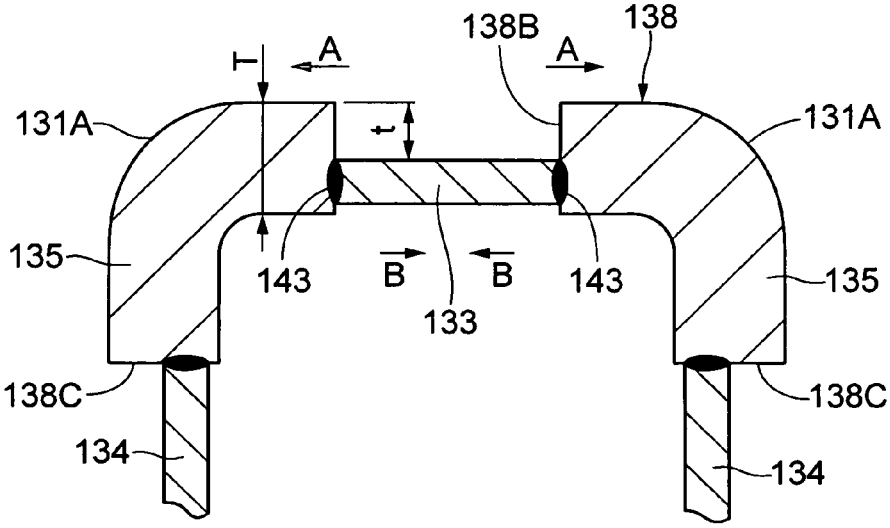
FIG. 34 is a fragmentary sectional view, showing part of the U-shaped structure of FIG. 33 on an enlarged scale.

At this time, as a bending operation proceeds, the right and left thick corner plates 135 are bent into L-shape in cross section as shown in FIG. 34 to serve as corner portions 131A of a square tubular structure 131 which is shown in FIG. 31. The flat thin plate 133 in a center position becomes an upper flat section 131B on the upper side of the square tubular structure 131.

Further, the right and left flat thin plates 134 become flat sections 131E at the right and left lateral sides of the square tubular structure 131. As shown in FIG. 33, an opening 138A is formed on the lower side of the U-shaped structure 138 between the right and left thick plates 136, and the opening 138A is closed by a plate-like member 139, which will be described hereinafter.

Formed on the outer side of the U-shaped structure 138 are raised and indented surfaces 138B and 138C due to a difference in thickness of the flat thin plates 133 and 134 from the thick corner plates 135. In this case, similar raised and indented surfaces are formed also on the inner side of the U-shaped structure 138.

Indicated at 139 is a plate-like member which constitutes the square tubular structure 131 together with the U-shaped structure 138. As shown in FIG. 33, this plate-like member 139 is constituted by a centrally located thin plate 140, and right and left thick plates 141 which are joined with opposite sides of the thin plate 140 by high energy density welding or the like.

Particularly in this case, as shown in FIG. 33, the thin plate 140 in the center and the right and left thick plates 141 joined by side to side butt welding at such intermediate positions in the direction of thickness as to form raised and indented surfaces both on upper and lower sides of the plate-like member 139. The plate-like member 139 is abutted against the opening 138A of the U-shaped structure 138 (against the lower ends of the thick plates 136) and securely joined with the thick plates 136 by high energy density welding or the like at joint portions 142 as shown in FIG. 31.

As a consequence, the opening 138A of the U-shaped structure 138 is closed by the plate-like member 139 from beneath to form a square tubular structure 131 which is square in cross section as shown in FIG. 31. The right and left corner portions 131C on the lower side of the square tubular structure 131 are formed in the vicinity of the joint portions 142 between the thick plates 136 of the U-shaped structure 138 and the thick plates 141 of the plate-like member 139, and a flat section 131D on the lower side of the square tubular structure 131 is defined by a lower surface of the plate-like member 139.

Being arranged in the manner as described above, the present embodiment can produce substantially the same effects as the foregoing first embodiment. However, according to the present embodiment, at the time of preparing the wide plate-like material 132, the flat thin plates 133 and 134 are abutted and joined with the thick corner plates 135 and the thick plates 136 at such intermediate positions as to form raised and indented surfaces on both sides of the wide plate-like material as shown in FIG. 32.

Therefore, it becomes possible to suppress exertion of tensile loads on the welded joints 143 between the flat thin plate 133 and the thick corner plates 135 when the thick corner plates 135 of the wide plate-like material 132 are bent into a convexly curved shape to form a U-shaped structure 138 as shown in FIG. 33, for example, for the purpose of preventing cracks from developing at the welded joints 143 starting from an end of a welding bead.

Especially in a case where the dimention t, corresponding to a dimension of indentation of the flat thin plate 133 from raised surfaces of the thick corner plates 135 is set, for example, approximately at a value of ½ (t=T/2) T where stands for the thickness of the thick corner plates 135 as shown in FIG. 34, it becomes possible to suppress and minimize exertion of tensile stresses acting in the directions of arrows A at the welded joints 143 between the flat thin plate 133 and the thick corner plates 135.

Thus, the welded joints 143 between the flat thin plate 133 and the thick corner plates 135 are almost free from tensile stresses acting in the directions of arrows A. Namely, there is little possibility of the welded joints 143 being degraded in strength under the influence of tensile stresses. With regard to compressive stresses exerted on the welded joints 143 acting in the directions of arrows B, these compressive stresses pose no adverse effects on the welded joints 143 between the flat thin plate 133 and the thick corner plates 135.

As a consequence, the welded joints 143 are unsusceptible to rupturing from an end of a welding bead, and thus sufficient strength is guaranteed for each one of the welded joints 143. Besides, the welded joints 143 of the U-shaped structure 138 are markedly reduced in residual tensile stress and can prolong fatigue life to a considerable degree, as compared with the U-shaped structure 32 in the foregoing first embodiment.

Further, similarly to the foregoing eighth embodiment, in the square tubular structure 131 which is constituted by the U-shaped structure 138 according to the present embodiment, the raised and indented surfaces 138B and 138C can add a sort of design effects to the outside of the square tubular structure 131 for the purpose of enhancing a commercial value as an operating arm of a construction machine.

In the foregoing embodiments of the invention, by way of example the square tubular structures 22, 22', 61, 71, 81, 91, 101, 121 and 131 are applied as an operating arm like the arm 21 on an offset boom type working mechanism 11. However, the present invention is not limited to the particular examples shown, and, for example, the square tubular structures can be similarly applied to the lower boom 12 and upper boom 13 shown in FIG. 1.

Figure 35:
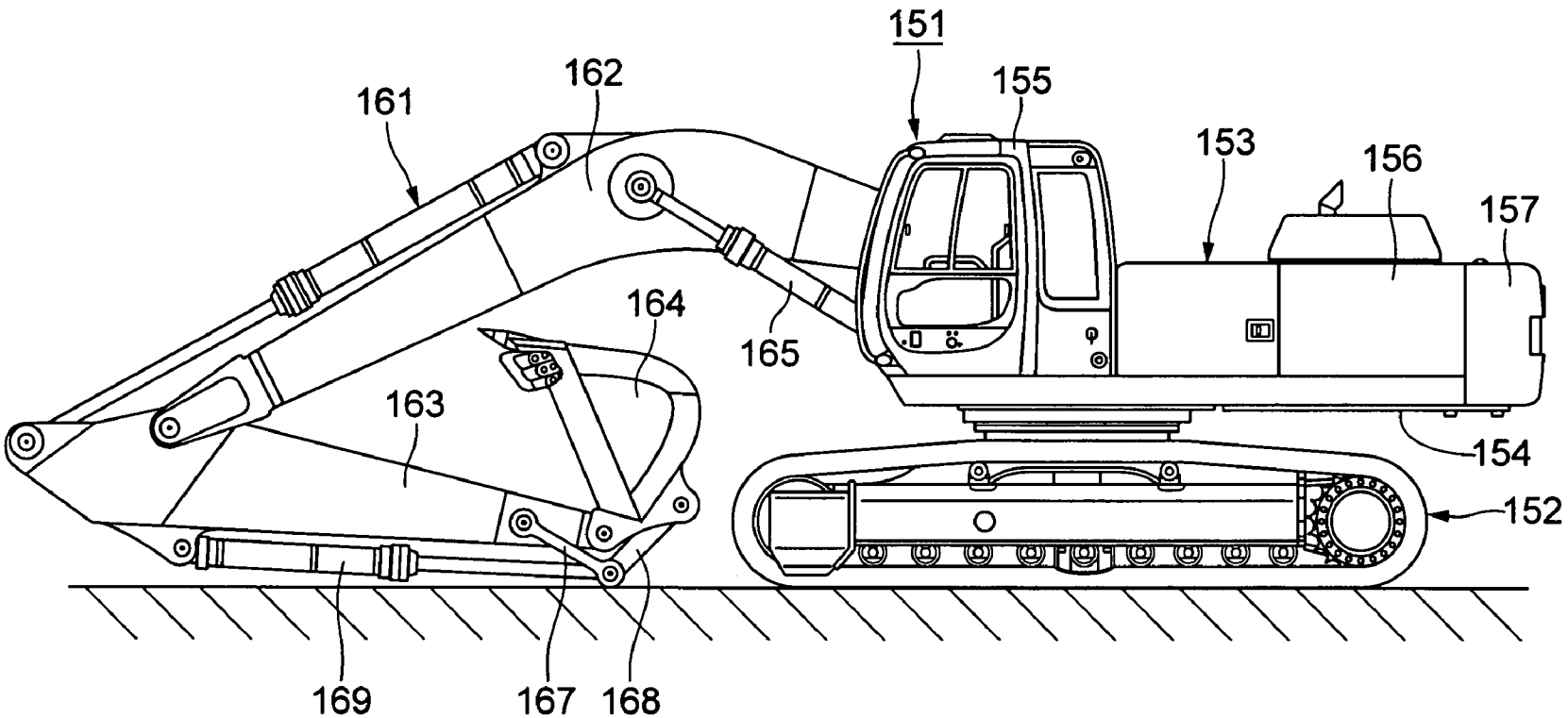
FIG. 35 is a front view of a hydraulic excavator in a modification according to the present invention.

Further, the present invention can find application not only as an operating arm on a working mechanism like the offset boom type working mechanism 11, but also as an operating arm of a working mechanism 161 on a hydraulic excavator 151 which is shown in a modification of FIG. 35 as a standard machine. In this case, as a construction machine, the hydraulic excavator 151 is largely constituted by a crawler type automotive base structure 152, a revolving structure 153 and a working mechanism 161.

The revolving structure 153 includes a revolving frame 154, a cab 155 providing an operating room to be occupied by an operator at the control of the machine, a housing cover 156 serving as an exterior cover, and a counterweight 157.

The working mechanism 161 is liftably provided on a front side of the revolving structure 153, including a boom 162, an arm 163 and a front attachment like a bucket 164. A boom cylinder 165 is provided between the revolving frame 154 and the boom 162, and an arm cylinder 166 is provided between the boom 162 and the arm 163. Further, a bucket cylinder 169 for a front attachment is provided between the arm 163 and the bucket 164 through links 167 and 168.

In this case, as an operating arm, a square tubular structure similar to the square tubular structures 22, 22', 61, 71, 81, 91,

101, 121 and 131 in the above-described embodiments can be applied to the boom 162 and to the arm 163 as well.

Further, the present invention is widely applicable not only to crawler type hydraulic excavator but also to a working mechanism (front part) of a wheel type hydraulic excavator, a dredger or other construction machine like a hydraulic crane or the like.

On the other hand, the square tubular structure 91 adopted in the seventh embodiment is basically same construction as the square tubular structure 61 of the fourth embodiment shown in FIG. 17 except that the square tubular structure is turned upside down. In this regard, similarly to the square tubular structure 91, the square tubular structures 22, 22', 71, 81, 101, 121 and 131 in the foregoing first to third embodiments, fifth embodiment, sixth embodiment and eighth to tenth embodiments can be applied in an inverted form.

Furthermore, in the foregoing eighth to tenth embodiments of the invention, raised and indented surfaces 107B and 107C (125B, 125C, 138B and 138C) are formed on the outer side of a square tubular structure 101 (121 or 131) on purpose utilizing a difference in thickness between joined plates. According to the present invention, if desired, raised and indented surfaces as in the eighth to tenth embodiments may be similarly formed on the outer side of the square tubular structures 22, 22', 61, 71, 81 and 91 in the first to seventh embodiments of the invention.

The invention claimed is:

1. A method of fabricating an operating arm for a construction machine, said operating arm being constituted by a plural number of joined plates and in the shape of a square tubular structure in cross section, said method comprising the steps of:

preparing a wide plate-like material having alternately thick and thin wall portions in a transverse direction by butt welding side to side said plural number of joined plates in different thicknesses;

bending said wide plate-like material along said thick wall portions to form thick wall corner portions of said square tubular structure, and to form a U-shaped structure having a U-shape in cross section with an opening on one side, through plastic deformation; and welding a separate plate-like member to said U-shaped structure to close said opening to form said square tubular structure.

2. The method of fabricating an operating arm for a construction machine as defined in claim 1, wherein said preparing step further comprises welding a boss mounting thick plate to be formed into a boss mount member to one longitudinal end of said wide plate-like material, and bending said boss mounting thick plate into a U-shape in cross section simultaneously with the bending of said wide plate-like material to form said U-shaped structure.

3. The method of fabricating an operating arm for a construction machine as defined in claim 1, wherein said thin and thick plates are joined by high energy density welding of deep penetration in said preparing step.

4. The method of fabricating an operating arm for a construction machine according to claim 1, wherein said preparing step includes positioning surfaces of said thin wall portion flush with surfaces of said thick wall portions on an outside in the direction of thickness but indented from said thick wall portions on an inside in the direction of thickness prior to butt welding.

5. The method of fabricating an operating arm for a construction machine according to claim 1, wherein said preparing step includes positioning surfaces of said thin wall portions indented from surfaces of said thick wall portions on an outside in the direction of thickness but flush with said thick wall portions on an inside in the direction of thickness prior to butt welding.

6. The method of fabricating an operating arm for a construction machine according to claim 1, wherein said preparing step includes positioning surfaces of said thin wall portions indented from surfaces of said thick wall portions on both sides in the direction of thickness prior to butt welding.

* * * * *

UNITED STATES PATENT AND TRADEMARK OFFICE

CERTIFICATE OF CORRECTION

PATENT NO. : 7,670,099 B2
APPLICATION NO. : 10/550729
DATED : March 2, 2010
INVENTOR(S) : Nakajima et al.

It is certified that error appears in the above-identified patent and that said Letters Patent is hereby corrected as shown below:

Title page, item (54) Title: Should read,

-- (54) METHOD OF PRODUCING WORKING ARM FOR CONSTRUCTION MACHINE --.

Signed and Sealed this

Fourteenth Day of September, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,670,099 B2
APPLICATION NO. : 10/550729
DATED : March 2, 2010
INVENTOR(S) : Nakajima et al.

It is certified that error appears in the above-identified patent and that said Letters Patent is hereby corrected as shown below:

Title page, item (54) and at Column 1, lines 1-3, Title: Should read,

-- (54) METHOD OF PRODUCING WORKING ARM FOR CONSTRUCTION MACHINE --.

This certificate supersedes the Certificate of Correction issued September 14, 2010.

Signed and Sealed this

Second Day of November, 2010

David J. Kappos

David J. Kappos
*Director of the United States Patent and Trademark Office*